US010376017B2

(12) United States Patent
Blevens et al.

(10) Patent No.: US 10,376,017 B2
(45) **Date of Patent: *Aug. 13, 2019**

(54) ARTICLE OF FOOTWEAR WITH ELONGATED SHOCK ABSORBING HEEL SYSTEM

(71) Applicant: NIKE, Inc., Beaverton, OR (US)

(72) Inventors: Kimberly M. Blevens, Beaverton, OR (US); Graeme McMillan, Portland, OR (US); Enrique V. Santos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/840,856

(22) Filed: Dec. 13, 2017

(65) Prior Publication Data

US 2018/0098603 A1 Apr. 12, 2018

Related U.S. Application Data

(60) Continuation of application No. 15/139,647, filed on Apr. 27, 2016, now Pat. No. 9,867,428, which is a (Continued)

(51) Int. Cl.
*A43B 13/18* (2006.01)
*A43B 21/32* (2006.01)

(Continued)

(52) U.S. Cl.
CPC ..... *A43B 21/32* (2013.01); *A43B 1/0009* (2013.01); *A43B 1/0072* (2013.01); *A43B 7/06* (2013.01);

(Continued)

(58) Field of Classification Search
CPC ..... A43B 13/18; A43B 13/185; A43B 21/26; A43B 21/32; A43B 7/14

(Continued)

(56) References Cited

U.S. PATENT DOCUMENTS

D65,273 S 7/1924 Hill
1,655,319 A 1/1928 Lowey (Continued)

FOREIGN PATENT DOCUMENTS

CN 1750771 A 3/2006
CN 103313622 A 9/2013

(Continued)

OTHER PUBLICATIONS

Sep. 25, 2012—(WO) International Search Report and Written Opinion—PCT/US2011/049846.

(Continued)

*Primary Examiner* — Marie D Bays
(74) *Attorney, Agent, or Firm* — Banner & Witcoff, Ltd.

(57) ABSTRACT

An article of footwear is disclosed having at least one elongated heel support member. The elongated heel support member may be angled and extend from a heel region to a midfoot region, in order to disperse forces applied by a wearer's heel during movement. The heel system may include two heel support members, each associated with a side of the article of footwear. The article of footwear may also include a series of ribs in the midfoot region, which may abut a front edge of the heel support members. Finally, the article of footwear may include asymmetric side flaps extending downward from an upper plate so as to overlap a midsole.

20 Claims, 21 Drawing Sheets

Related U.S. Application Data division of application No. 13/974,699, filed on Aug. 23, 2013, now Pat. No. 9,351,533, which is a division of application No. 12/881,449, filed on Sep. 14, 2010, now Pat. No. 8,584,377.

(51) Int. Cl.

| | |
|---|---|
| ***A43B 13/12*** | (2006.01) |
| ***A43B 1/00*** | (2006.01) |
| ***A43B 21/26*** | (2006.01) |
| ***A43B 7/06*** | (2006.01) |
| ***A43B 7/14*** | (2006.01) |
| ***A43B 13/04*** | (2006.01) |
| ***A43B 13/10*** | (2006.01) |
| ***A43B 23/17*** | (2006.01) |
| ***A43B 13/22*** | (2006.01) |

(52) U.S. Cl.

CPC ..... *A43B 7/14* (2013.01); *A43B 7/144* (2013.01); *A43B 13/04* (2013.01); *A43B 13/10* (2013.01); *A43B 13/12* (2013.01); *A43B 13/125* (2013.01); *A43B 13/18* (2013.01); *A43B 13/181* (2013.01); *A43B 13/185* (2013.01); *A43B 13/187* (2013.01); *A43B 13/223* (2013.01); *A43B 21/26* (2013.01); *A43B 23/17* (2013.01)

(58) Field of Classification Search

USPC ..... 36/88, 92, 28, 30 R, 35 R, 37, 69, 142, 36/143, 144

See application file for complete search history.

(56) References Cited

U.S. PATENT DOCUMENTS

| | | | |
|---|---|---|---|
| 2,099,394 | A | 11/1937 | Gordon |
| 2,124,819 | A | 7/1938 | Halloran |
| D115,227 | S | 6/1939 | Ziniti |
| D122,607 | S | 9/1940 | Nutt |
| 2,444,865 | A | 7/1948 | Warrington |
| 4,133,118 | A | 1/1979 | Khalsa et al. |
| 4,259,792 | A | 4/1981 | Halberstadt |
| 4,484,397 | A | 11/1984 | Curley, Jr. |
| 4,506,460 | A | 3/1985 | Rudy |
| 4,610,099 | A | 9/1986 | Signori |
| 4,730,402 | A | 3/1988 | Norton et al. |
| 4,817,304 | A | 4/1989 | Parker et al. |
| 4,854,055 | A | 8/1989 | Sugiyama et al. |
| 4,864,737 | A | 9/1989 | Marrello |
| 5,005,299 | A | 4/1991 | Whatley |
| 5,060,401 | A | 10/1991 | Whatley |
| 5,086,574 | A | 2/1992 | Bacchiocchi |
| 5,131,173 | A | 7/1992 | Anderie |
| 5,185,943 | A | 2/1993 | Tong et al. |
| 5,218,773 | A | 6/1993 | Beekman |
| 5,279,051 | A | 1/1994 | Whatley |
| D344,399 | S | 2/1994 | Kilgore |
| D351,720 | S | 10/1994 | Kilgore |
| 5,595,003 | A | 1/1997 | Snow |
| 5,625,963 | A | 5/1997 | Miller et al. |
| 5,628,128 | A | 5/1997 | Miller et al. |
| 5,729,917 | A | 3/1998 | Slepian et al. |
| 5,743,028 | A | 4/1998 | Lombardino |
| 5,797,199 | A | 8/1998 | Miller et al. |
| 5,799,417 | A | 9/1998 | Burke et al. |
| 5,839,208 | A | 11/1998 | Huang |
| 5,937,544 | A | 8/1999 | Russell |
| 6,023,859 | A | 2/2000 | Burke et al. |
| 6,195,915 | B1 | 3/2001 | Russell |
| 6,219,939 | B1 | 4/2001 | Kita et al. |
| 6,282,814 | B1 | 9/2001 | Krafsur et al. |
| 6,327,795 | B1 | 12/2001 | Russell |
| 6,330,757 | B1 | 12/2001 | Russell |
| 6,401,366 | B2 | 6/2002 | Foxen et al. |
| 6,457,261 | B1 | 10/2002 | Crary |
| 6,487,796 | B1 | 12/2002 | Avar et al. |
| 6,568,102 | B1 | 5/2003 | Healy et al. |
| 6,598,320 | B2 | 7/2003 | Turner et al. |
| 6,722,058 | B2 | 4/2004 | Lucas et al. |
| 6,763,612 | B2 | 7/2004 | Stubblefield et al. |
| 6,842,999 | B2 | 1/2005 | Russell |
| 6,886,274 | B2 | 5/2005 | Krafsur et al. |
| 6,931,766 | B2 | 8/2005 | Greene |
| 7,036,245 | B2 | 5/2006 | Russell |
| 7,080,467 | B2 | 7/2006 | Marvin et al. |
| 7,082,698 | B2 | 8/2006 | Smaldone et al. |
| 7,086,179 | B2 | 8/2006 | Dojan et al. |
| 7,100,309 | B2 | 9/2006 | Smith et al. |
| 7,168,186 | B2 | 1/2007 | Russell |
| 7,168,686 | B2 | 1/2007 | Ehrenleitner |
| D542,522 | S | 5/2007 | Fujita et al. |
| 7,219,447 | B2 | 5/2007 | LeVert et al. |
| D553,337 | S | 10/2007 | Portzline |
| 7,281,343 | B2 | 10/2007 | Riha et al. |
| D554,340 | S | 11/2007 | Portzline |
| 7,334,349 | B2 | 2/2008 | Sokolowski et al. |
| 7,337,559 | B2 | 3/2008 | Russell |
| 7,340,850 | B2 | 3/2008 | Lin et al. |
| 7,676,955 | B2 | 3/2010 | Dojan et al. |
| 7,866,063 | B2 | 1/2011 | Caine et al. |
| 7,946,059 | B2 | 5/2011 | Borel |
| 8,161,667 | B2 | 4/2012 | Hwang |
| 8,327,560 | B2 | 12/2012 | Berend |
| 8,584,377 | B2 | 11/2013 | Blevens et al. |
| 8,776,397 | B2 | 7/2014 | Borel et al. |
| 9,192,209 | B2 | 11/2015 | Blevens et al. |
| 9,289,026 | B2 | 3/2016 | Blevens et al. |
| 9,351,533 | B2 | 5/2016 | Blevens et al. |
| 2001/0001904 | A1 | 5/2001 | Hernadez |
| 2001/0032400 | A1 | 10/2001 | Brooks |
| 2002/0092201 | A1 | 7/2002 | Kraeuter et al. |
| 2003/0061731 | A1 | 4/2003 | Turner |
| 2003/0061732 | A1 | 4/2003 | Turner |
| 2004/0128860 | A1 | 7/2004 | Smaldone et al. |
| 2004/0194347 | A1 | 10/2004 | Aveni et al. |
| 2004/0221485 | A1 | 11/2004 | Pfander |
| 2004/0261292 | A1 | 12/2004 | Aveni et al. |
| 2005/0155254 | A1 | 7/2005 | Smith et al. |
| 2005/0210705 | A1 | 9/2005 | Grove et al. |
| 2005/0278980 | A1 | 12/2005 | Berend et al. |
| 2006/0021255 | A1 | 2/2006 | Auger et al. |
| 2006/0112592 | A1 | 6/2006 | Leedy et al. |
| 2006/0130362 | A1 | 6/2006 | Juan |
| 2006/0179683 | A1 | 8/2006 | Weiss et al. |
| 2006/0185191 | A1 | 8/2006 | Crowley |
| 2006/0191162 | A1 | 8/2006 | Aveni et al. |
| 2006/0288611 | A1 | 12/2006 | Hogan |
| 2007/0144037 | A1 | 6/2007 | Russell |
| 2007/0227041 | A1 | 10/2007 | Menghini |
| 2007/0240331 | A1 | 10/2007 | Borel |
| 2007/0256326 | A1 | 11/2007 | Jarvis |
| 2008/0201982 | A1 | 8/2008 | Aveni et al. |
| 2008/0201984 | A1 | 8/2008 | Dojan et al. |
| 2008/0307676 | A1 | 12/2008 | Caine et al. |
| 2009/0013556 | A1 | 1/2009 | Nishiwaki et al. |
| 2009/0019729 | A1 | 1/2009 | Nakano et al. |
| 2009/0100705 | A1 | 4/2009 | Cook et al. |
| 2009/0217548 | A1 | 9/2009 | Leedy et al. |
| 2009/0260259 | A1 | 10/2009 | Berend |
| 2009/0320330 | A1 | 12/2009 | Borel et al. |
| 2010/0058617 | A1 | 3/2010 | Hwang |
| 2010/0236096 | A1 | 9/2010 | Pauk et al. |
| 2011/0185590 | A1 | 8/2011 | Nishiwaki et al. |
| 2011/0197469 | A1 | 8/2011 | Nishiwaki et al. |
| 2011/0232128 | A1 | 9/2011 | Propet |
| 2012/0060395 | A1 | 3/2012 | Blevens et al. |
| 2013/0000157 | A1 | 1/2013 | Wu |
| 2013/0019497 | A1 | 1/2013 | Sullivan et al. |
| 2014/0053429 | A1 | 2/2014 | Blevens et al. |
| 2014/0059888 | A1 | 3/2014 | Blevens et al. |

(56) References Cited

U.S. PATENT DOCUMENTS

| | | | |
|---|---|---|---|
| 2014/0068969 | A1 | 3/2014 | Blevens et al. |
| 2014/0208610 | A1 | 7/2014 | Dirsa et al. |

FOREIGN PATENT DOCUMENTS

| | | | |
|---|---|---|---|
| EP | 0161653 | A1 | 11/1985 |
| EP | 1714571 | A1 | 10/2006 |
| EP | 2057913 | A1 | 5/2009 |
| EP | 2615936 | A2 | 7/2013 |
| WO | 2012036897 | A2 | 3/2012 |

OTHER PUBLICATIONS

Mar. 28, 2013—(WO) International Preliminary Report on Patentability (including Written Opinion of the ISA)—App PCT/US2011/049846.

May 30, 2012—(WO) Partial International Search Report—Appl—PCT/US2011/049846.

ARTICLE OF FOOTWEAR WITH ELONGATED SHOCK ABSORBING HEEL SYSTEM

CROSS-REFERENCE TO RELATED APPLICATIONS

This application is a continuation of U.S. patent application Ser. No. 15/139,647 filed Apr. 27, 2016, which is a divisional of co-pending application of U.S. patent application Ser. No. 13/974,699 filed Aug. 23, 2013, now U.S. Pat. No. 9,351,533, which is a divisional application of U.S. patent application Ser. No. 12/881,449 filed Sep. 14, 2010, now U.S. Pat. No. 8,584,377, all of which are herein incorporated by reference in their entirety.

BACKGROUND

The present embodiments relate generally to footwear, and in particular an article of footwear including heel support members.

Articles of footwear with support columns along the heel of the footwear have been previously proposed. Smith et al. (U.S. Pat. No. 7,100,309) teaches a track shoe with a heel plate and two support columns. In the Smith design, the article of footwear includes an upper and a sole secured to the upper. Specifically, Smith teaches the use of a heel plate extending from the midfoot portion of the outsole towards to the heel. The first and second support columns extend between the heel plate and the outsole in a vertical direction. The support columns of the Smith design are intended to attenuate shock and absorb energy in the event that a user tires and the heel portion of the footwear contacts the ground.

Other articles of footwear with heel support structures have also been proposed. Caine et al. (U.S. patent application publication No. 2008/0307676) teaches an article of footwear with a shock absorbing heel system. The heel system includes a lower heel plate, a set of support members, and an upper heel plate. The lower heel plate is associated with a cantilever portion that supports the upper heel plate laterally. As force is applied to the heel system, the support members may compress slightly and the cantilever portion may lower, absorbing energy and or shocks applied by the ground. Each support member includes a top side and a bottom side; the top side being associated with a first centroid and the bottom side being associated with a second centroid; and where the first centroid and the second centroid are misaligned with respect to a vertical axis.

SUMMARY

An article of footwear is disclosed. The article of footwear may include an elongated shock absorbing heel system, which distributes the force applied by a wearer's heel during movement in an efficient and comfortable manner. The article of footwear may further include additional features which aid in controlling and distributing the forces applied by a wearer's foot during movement.

In particular, in one aspect, this disclosure provides an article of footwear, comprising: a sole, the sole including a heel system; the heel system including a support member; the support member including a top side and a bottom side; and where the top side has a first total surface area, the bottom side has a second total surface area, and the second total surface area is larger than the first total surface area.

In another aspect, this disclosure provides an article of footwear, comprising: a sole, the sole including a heel system; the heel system including a first support member associated with a lateral side of the article of footwear; the heel system further including a second support member associated with a medial side of the article of footwear; the first support member including a first top side and a first bottom side; the second support member including a second top side and a second bottom side; the first top side having a first top side perimeter; the first bottom side having a first bottom side perimeter; the second top side having a second top side perimeter; the second bottom side having a second bottom side perimeter; and where the first top side perimeter is located within a boundary defined by the first bottom side perimeter, and the second top side perimeter is located within a boundary defined by the second bottom side perimeter.

In another aspect, this disclosure provides an article of footwear, comprising: a sole, the sole including a heel system; the heel system including a first support member associated with a lateral side of the article of footwear; the heel system further including a second support member associated with a medial side of the article of footwear; the first support member including a first top side and a first bottom side; the second support member including a second top side and a second bottom side; the first top side including a first rear surface region, a first peripheral surface region and a first center surface region; the second top side including a second rear surface region, a second peripheral surface region and a second center surface region; the first peripheral surface region being associated with a lateral side of the first top side, and the second peripheral region being associated with a medial side of the second top side; the first rear surface region and the second rear surface region are each curved vertically upward; and where the first peripheral surface region and the second peripheral surface region are each curved vertically upward.

In another aspect, this disclosure provides an article of footwear comprising: a sole; the sole including a midsole and an upper plate; the upper plate including a lateral side flap and a medial side flap; and where the lateral side flap and the medial side flap each are located in a heel region of the article of footwear and extend downward from the upper plate so as to overlap the midsole.

In another aspect, this disclosure provides an article of footwear comprising: a sole; the sole including a midsole and an upper plate; the midsole including a first heel support member associated with a lateral side of the article of footwear and a second heel support member associated with a medial side of the article of footwear; the upper plate including a lateral side flap and a medial side flap, each of the lateral side flap and the medial side flap extending downward from the upper plate; the lateral side flap overlapping a lateral side of the first heel support member; and the medial side flap overlapping a medial side of the second heel support member.

In another aspect, this disclosure provides an article of footwear, comprising: a sole; the sole including an outsole, and a lower plate adjacent to the outsole; the lower plate including at least one rib; the lower plate further including a wall extending upward from the lower plate and aligned transversely across the article of footwear, the wall being located in a midfoot region of the article of footwear; and where the at least one rib extends from the wall towards a heel region of the article of footwear.

In another aspect, this disclosure provides an article of footwear, comprising: a sole; the sole including an outsole, a lower plate; a first heel support member, and second heel support member; the lower plate being arranged between the outsole and the first and second heel support members; the lower plate including at least one rib; the lower plate further including a wall extending upward from the lower plate and aligned transversely across the article of footwear, the wall being located in a midfoot region of the article of footwear; and where the at least one rib extends from the wall towards a heel region of the article of footwear.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
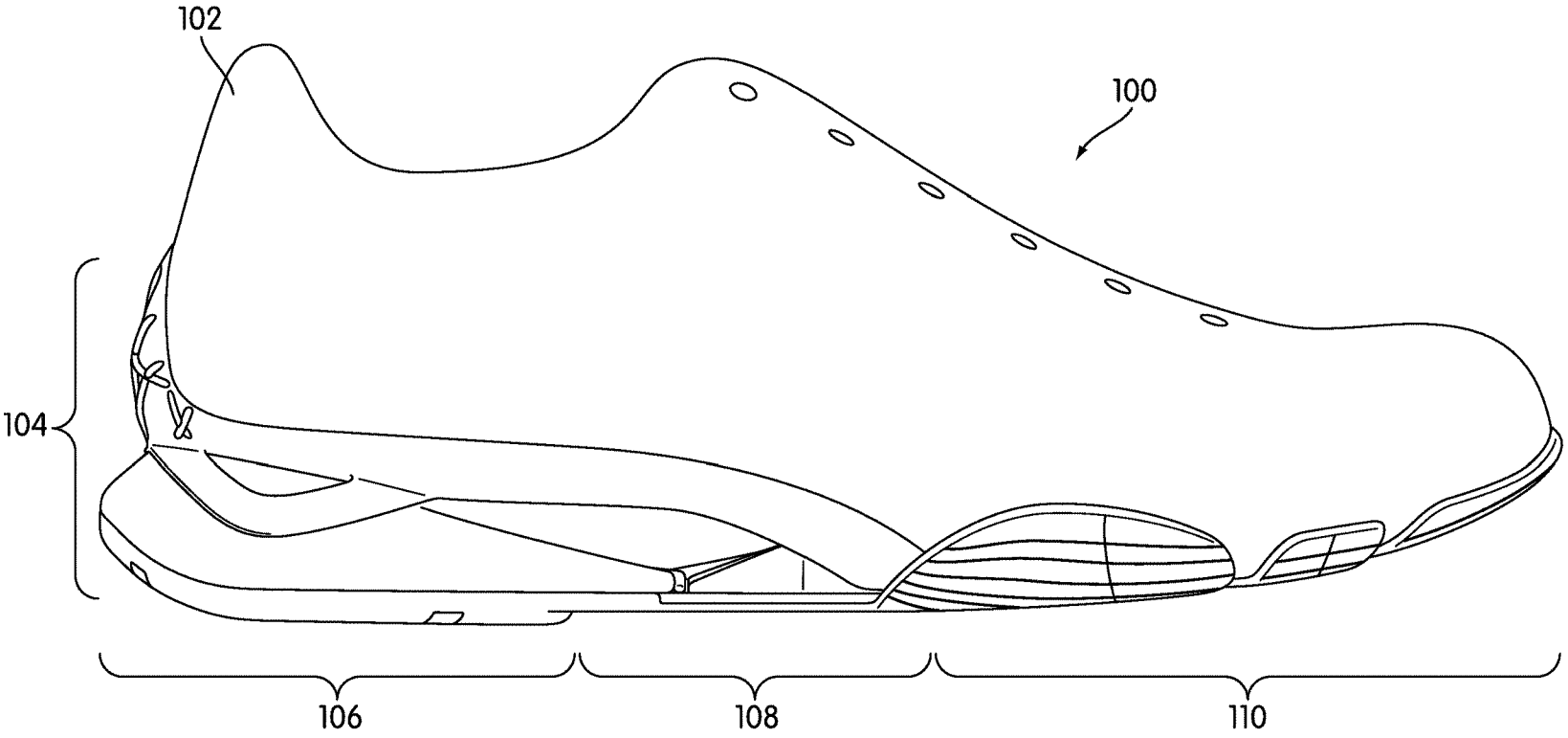
FIG. 1 is a side view of an embodiment of an article of footwear.
Figure 2:
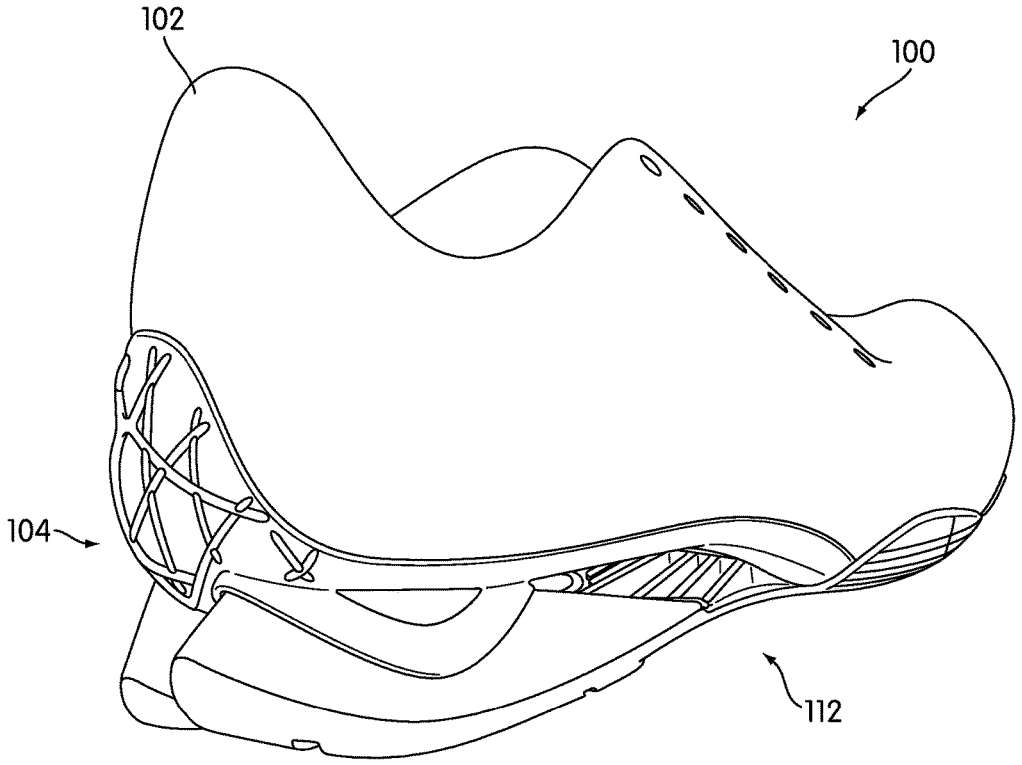
FIG. 2 is a lateral rear view of an embodiment of the article of footwear.
Figure 3:
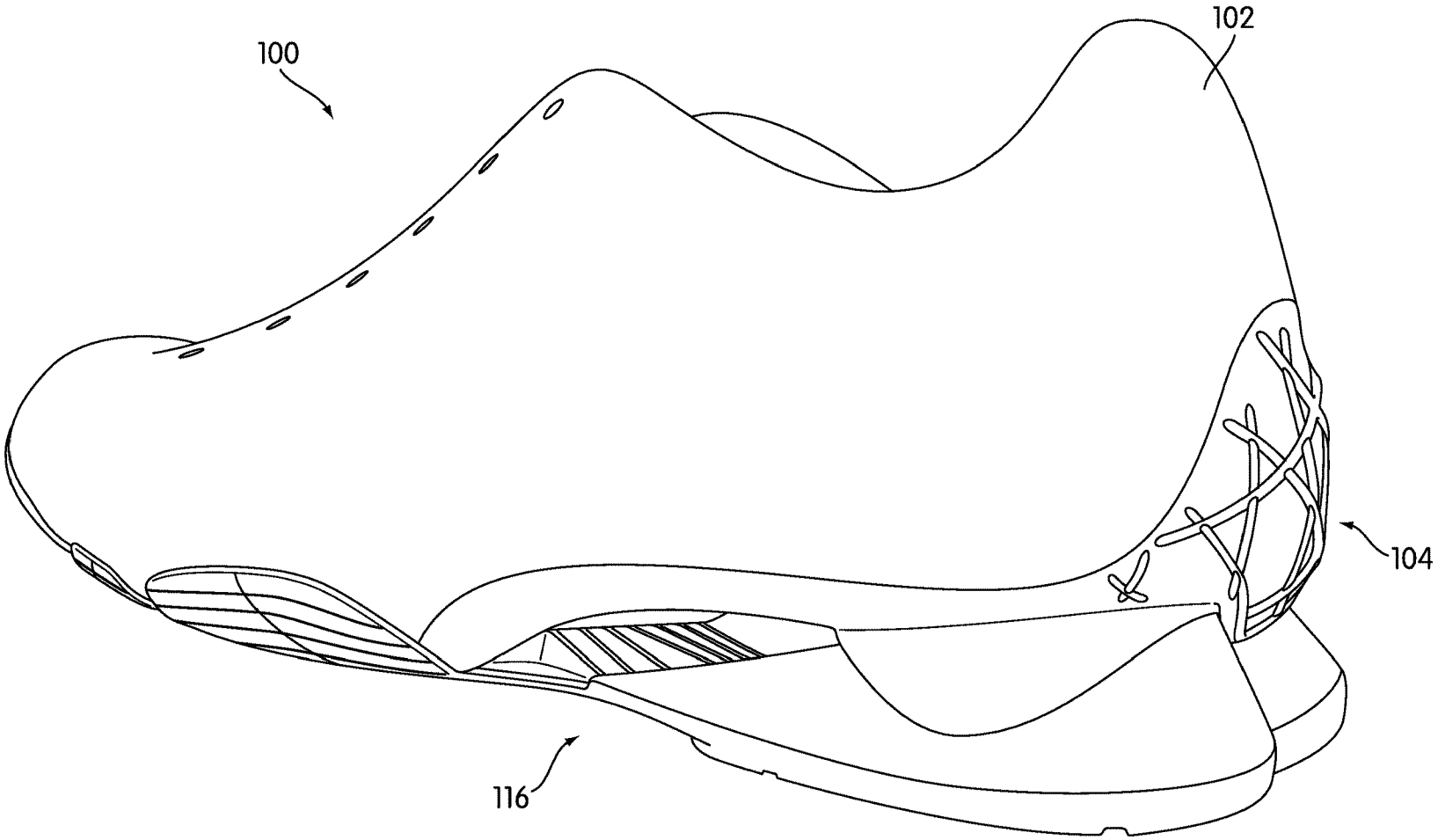
FIG. 3 is a medial rear view of an embodiment of the article of footwear.

FIGS. 1 through 3 illustrate views of one embodiment of an article of footwear 100. FIG. 1 is a side view of an exemplary embodiment of article of footwear 100. In this embodiment, article of footwear 100 may be a running shoe. For clarity, the following detailed description discusses an exemplary embodiment, however, the present disclosure also relates to any other form of footwear including, for example, any type of athletic shoes, boots, as well as other kinds of footwear. As shown throughout the figures, article of footwear 100 is intended to be used with a right foot, however it should be understood that the following discussion may equally apply to a mirror image of article of footwear 100 that is intended for use with a left foot.

Article of footwear 100 may include upper 102. Upper 102 receives and comfortably secures article of footwear 100 to a foot of a wearer. Generally, upper 102 may be made from any material that is suitable for use as an upper. Examples of suitable materials include, but are not limited to, nylon, natural leather, synthetic leather, natural rubber, or synthetic rubber, as well as other materials. Article of footwear 100 may also include sole 104. Generally, sole 104 may be made from any material that is suitable for use as a sole. For example, sole 104 may be made from materials such as elastomers, siloxanes, natural rubber, other synthetic rubbers, aluminum, steel, natural leather, synthetic leather, or plastics. In one embodiment, sole 104 may be made of rubber. As discussed below, different components making up sole 104 may also be made from different, separate materials. Sole 104 may be secured to upper 102 by an adhesive, or any other suitable fastening means.

Article of footwear 100 may be divided into three general portions: a heel region 106, a midfoot region 108, and a forefoot region 110. Heel region 106, midfoot region 108, and forefoot region 110 are not intended to demarcate precise areas of article of footwear 101. Rather, region 106, region 108, and region 110 are intended to represent general areas of article of footwear 100 that provide a frame of reference.

As shown in FIGS. 2 and 3, article of footwear 100 has a lateral side 112 and a medial side 116. As the terms are generally known and used in the art, medial side 116 is closest to a midline of a wearer's body, and lateral side 112 is farthest away from the midline of the wearer's body.

Unless otherwise stated, or otherwise clear from the context below, directional terms used herein, such as rearwardly, forwardly, inwardly, downwardly, upwardly, etc., refer to directions relative to article of footwear 100 itself. Article of footwear 100 is shown in FIG. 1 to be disposed substantially horizontally, as it would be positioned on a horizontal surface when worn by a wearer. However, it is to be appreciated that article of footwear 100 need not be limited to such an orientation. Accordingly, in the illustrated embodiment of FIG. 1, the rearward (back) direction is toward heel region 106, that is, to the left as seen in FIG. 1. Accordingly, the forward (front) direction is toward forefoot region 110, that is, to the right as seen in FIG. 1. Similarly, downward is toward sole 104 from upper 102 (toward the bottom of the page as seen in FIG. 1), and upward is toward upper 102 from sole 104 (toward the top of the page as seen in FIG. 1). The downward and upward directions may also be indicated by referencing the top or bottom of a particular component. Finally, inwardly is toward the center of article of footwear 100, and outwardly is toward an outer peripheral edge of article of footwear 100 (either in the lateral or medial direction).

Figure 4:
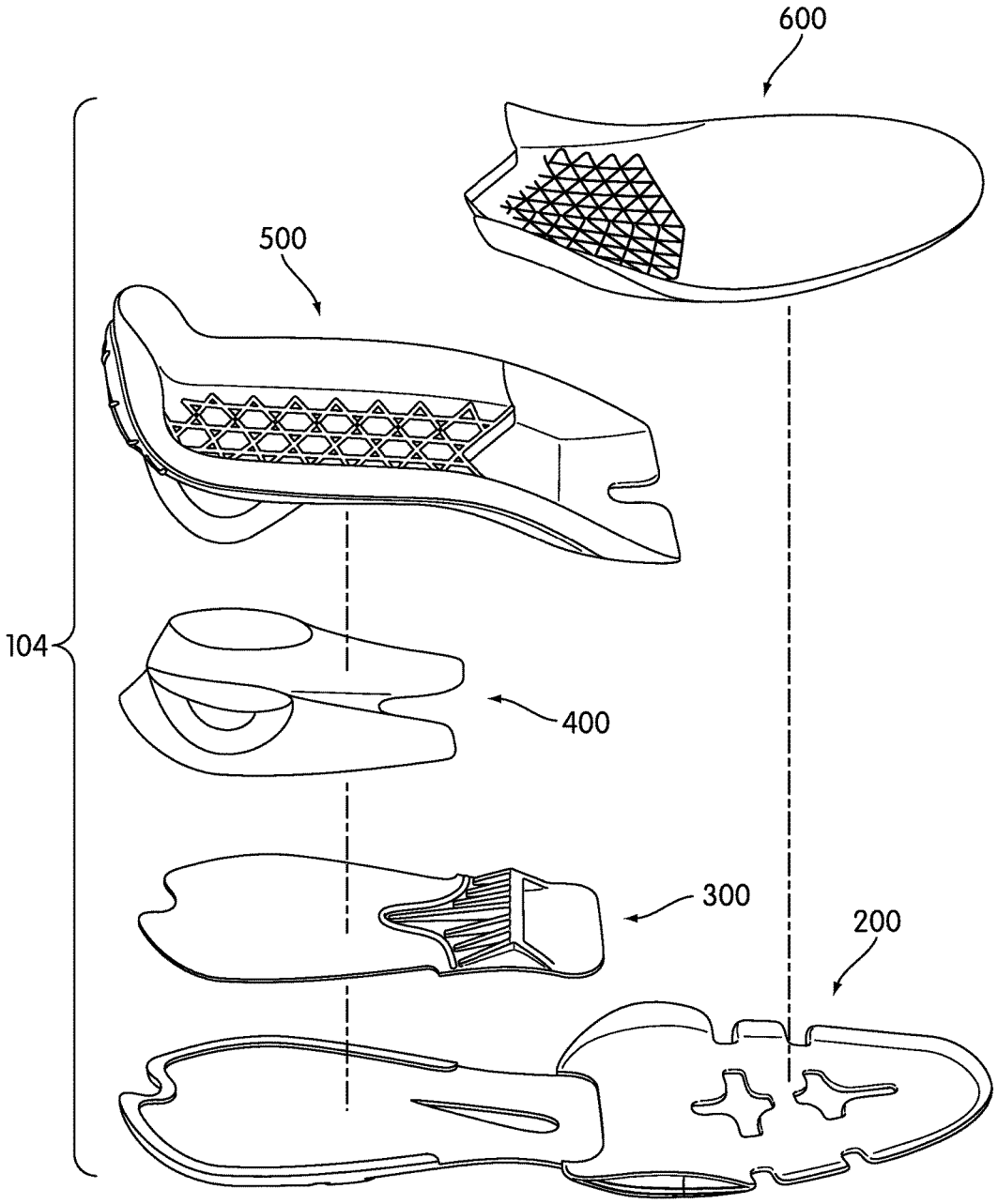
FIG. 4 is an isometric view of several components comprising an exemplary embodiment of a sole.

FIG. 4 illustrates an isometric view of various components making up sole 104. Specifically, sole 104 may be made up of an outsole 200, a lower plate 300, a heel support system 400, an upper plate 500, and a forefoot plate 600. Each of these components may be layered on top of each other, in the order shown in FIG. 4. In other words, each component making up sole 104 may be contiguous with at least a portion of at least one other component, and some components may be sandwiched between two other components. Specifically, lower plate 300 may be adjacent to outsole 200 on a bottom side of lower plate 300 and adjacent to heel. system 400 on a top side of lower plate 300. In addition, heel system 400 may be adjacent to lower plate 300 on a bottom side of heel system 400 and adjacent to upper plate 500 on a top side of heel system 400. Also, upper plate 500 may be adjacent to heel system 400 on a bottom side of upper plate 500 in a rear portion and adjacent to a portion of lower plate 300 on the bottom side forward portion of upper plate 500. And finally, forefoot plate 600 may be adjacent to upper plate 500 on a bottom side in a rear portion and adjacent to outsole 200 on a forward portion of the bottom side of forefoot plate 600.

Generally, the components of sole 104 can be assembled in any manner. In some embodiments, the various components of sole 104 may be combined using glue or another type of adhesive. For instance, heel support structure 400 may be glued to lower plate 300. Additionally, lower plate 300 may be glued to outsole 200. In some embodiments, heel support system 400 may be glued directly to upper plate 500. In other embodiments, these various components may be attached in other ways.

Figure 5:
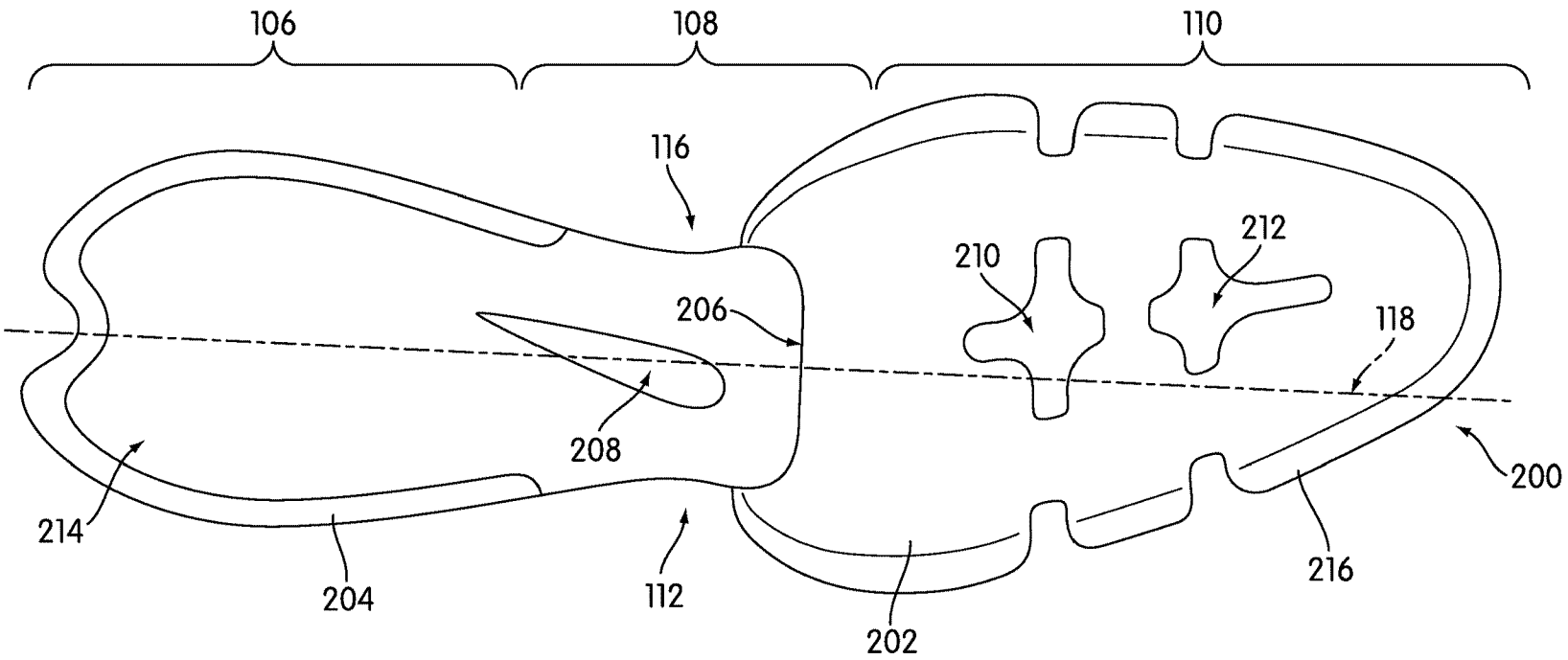
FIG. 5 is a top view of an embodiment of an outsole.

FIG. 5 illustrates an embodiment of outsole 200 in detail. Specifically, FIG. 5 shows an upper side 202 of outsole 200. Outsole 200 generally includes heel region 106, a midfoot region 108, and a forefoot region 110, as well as lateral side 112 and medial side 116, all as discussed above. Outsole 200, and other components of sole 104, may be discussed with reference to center axis 118, which may be defined as a line that bisects article of footwear 100 in heel region 106 and midfoot region 108.

Upper side 202 of outsole 200 includes a variety of features that interact with other components of sole 104. For example, upper side 202 includes a depressed region 214 partially surrounded by a ridge 204 in heel region 106 and midfoot region 108. Depressed region 214 may have a forward boundary 206 in midfoot region 108. Outsole 200 also may include hole 208 within depressed region 214, as well as first hole 210 and second hole 212 within forefoot region 110. In some cases, each of midfoot hole 208, first forefoot hole 210 and second forefoot hole 212 may extend through the entire thickness of outsole 200. In other cases, each hole may only extend through a portion the thickness of outsole 200. In some embodiments, upper side 202 of outsole 200 may include side edges 216 in forefoot region 110 that curl upward.

Figure 6:
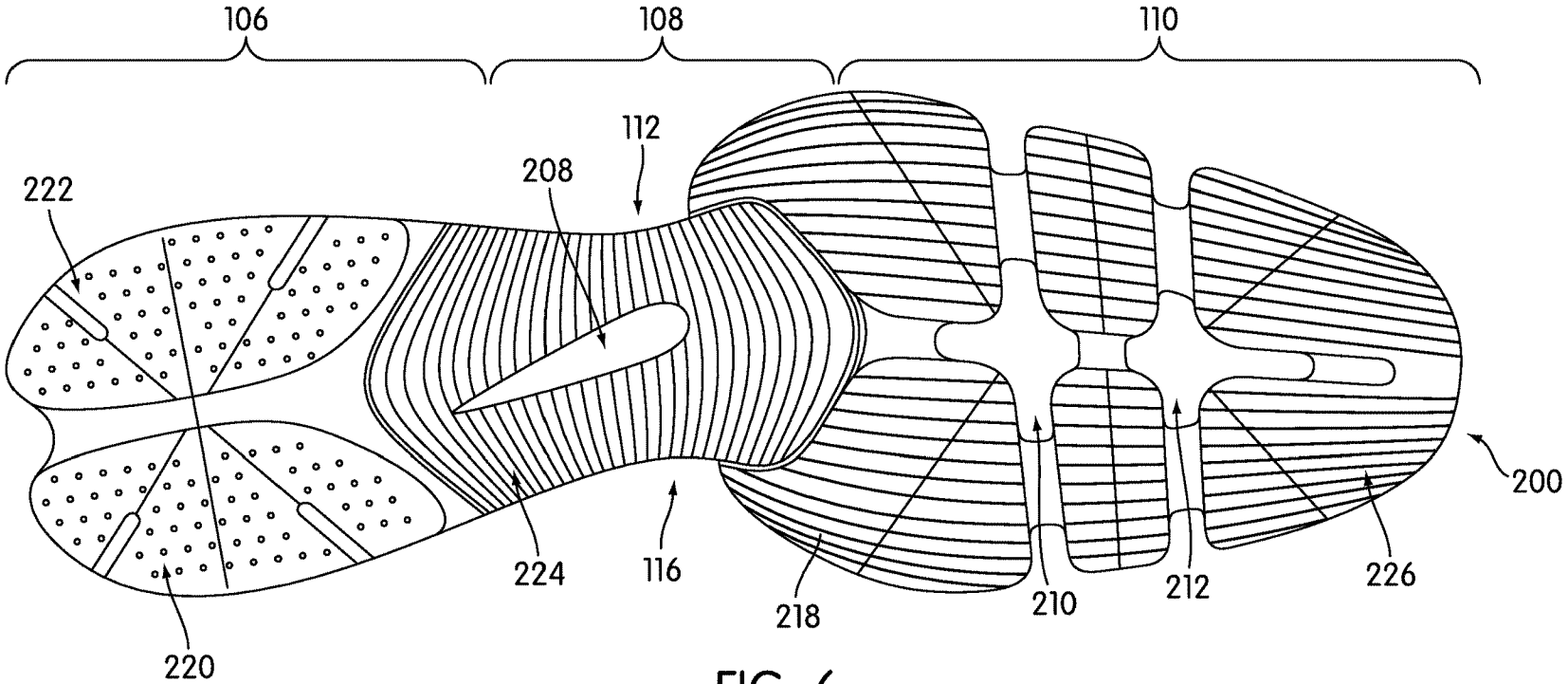
FIG. 6 is a bottom view of an embodiment of the outsole.

FIG. 6 illustrates an embodiment of a bottom side 218 of outsole 200. Bottom side 218 generally may include a variety of treads for engaging and gripping the ground during movement in order to provide increased traction. Specifically, for example, bottom side 218 may include tread 220 and tread 222 in heel region 106. First heel region tread 220 may be associated with medial side 116, and second heel region tread 222 may be associated with lateral side 112. Bottom side 218 may include tread 224 in midfoot region 108. Also, bottom side 218 may include tread 226 in forefoot region 110. In some embodiments, tread patterns associated with different regions can vary. For example, tread 226 may comprise ridges that extend in a generally longitudinal direction, while tread 224 can comprise ridges that extend in a generally lateral direction. In addition, tread 220 and tread 222 may comprise raised dimples or bumps. In other embodiments, tread patterns can be substantially similar over different regions. In addition to the tread patterns as shown in FIG. 6, treads on bottom side 218 of outsole 200 may also be in the form of any tread pattern generally known in the art of footwear.

Figure 7:
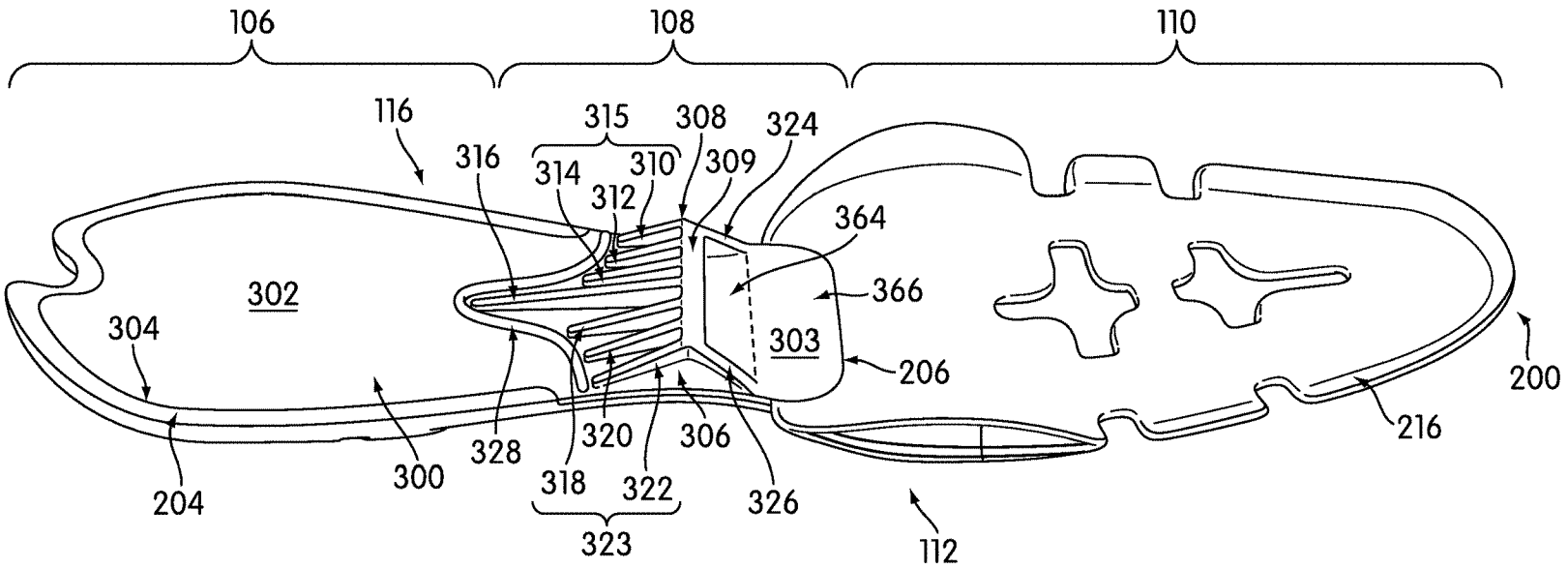
FIG. 7 is an isometric view of an embodiment of a lower plate and outsole.
Figure 8:
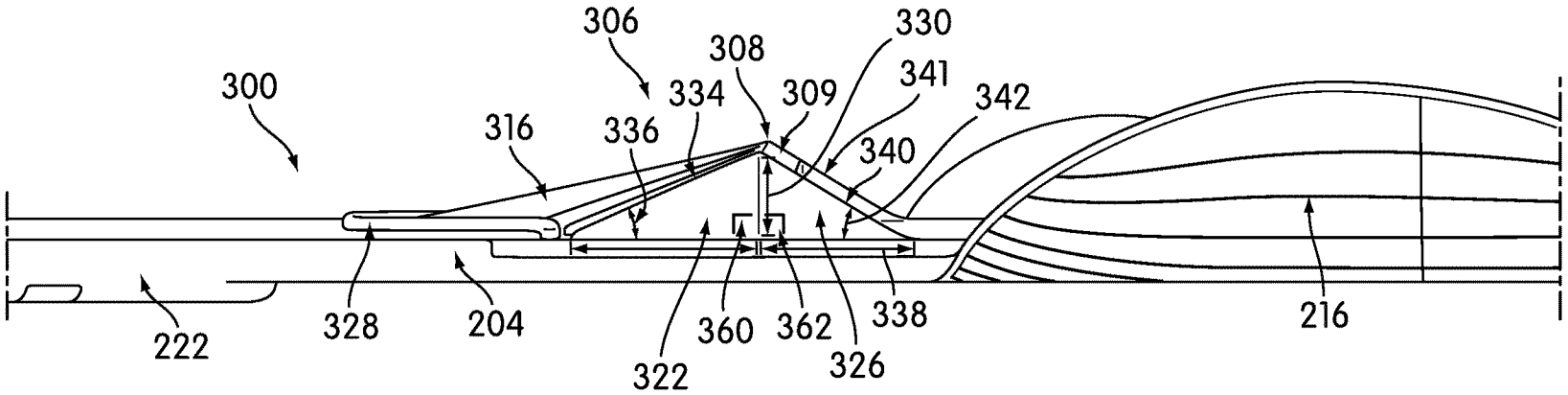
FIG. 8 is a close-up side view of an embodiment of a portion of the lower plate.
Figure 9:
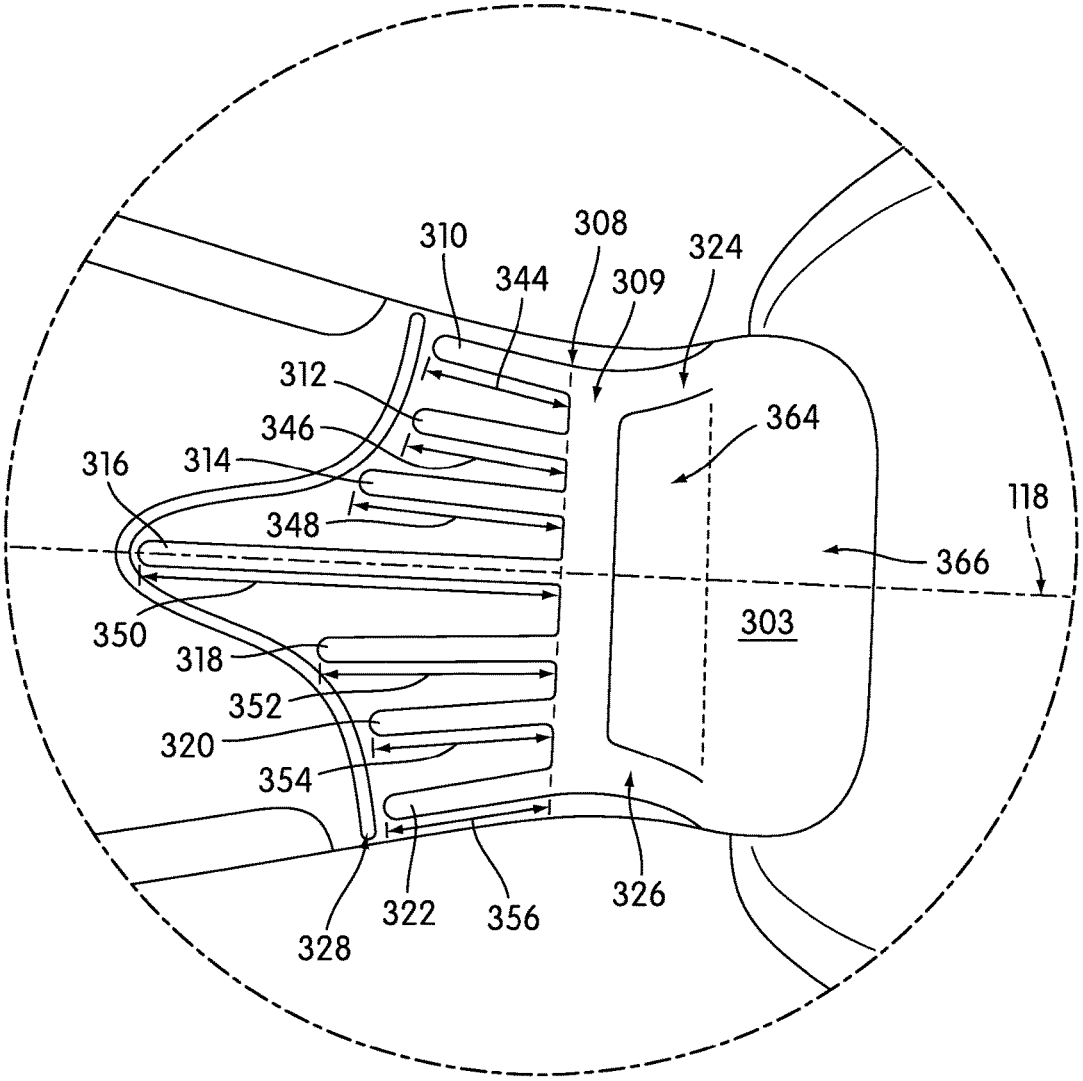
FIG. 9 is a close-up top view of an embodiment of a portion of the lower plate.

FIGS. 7 through 9 illustrate details of an exemplary embodiment of lower plate 300. For example, FIG. 7 shows an isometric view of lower plate 300 atop outsole 200. Lower plate 300 may be considered to be part of a midsole in article of footwear 100. Namely, lower plate 300 may be considered to be part of a midsole since lower plate 300 is situated between outsole 200 and upper 102, and includes provisions for adsorbing forces created by a wearer's foot during movement.

Generally, lower plate 300 may be contiguous with outsole 200 in heel region 106 and midfoot region 108. Specifically, in heel region 106, lower plate 300 may include a first substantially flat region 302 having an outer peripheral edge 304 that may be surrounded by outsole ridge 204. In some embodiments, first substantially flat region 302 may be substantially coplanar with a top surface of ridge 204.

In midfoot region 108, lower plate 300 includes a variety of structures configured to absorb and transmit forces applied by a wearer's foot during movement. Specifically, lower plate 300 includes at least one rib 306, and a wall 308. Wall 308 extends upward from lower plate 300 and is aligned transversely across article of footwear 100. Wall 308 may be aligned transversely across article of footwear 100, i.e. from lateral side 112 to medial side 116, at any particular angle. In some embodiments wall 308 is substantially perpendicular to center line 118, as shown in FIG. 9. Wall 308 includes a wall top surface 309, which may be aligned so as to be angled downward towards forefoot region 110.

Wall 308 may also be contiguous with one or more side walls. Side walls may be located in midfoot region 108, and may extend from wall 308 towards forefoot region 110. Specifically, medial side wall 324 may be associated with medial side 116 of article of footwear 100, and lateral side wall 326 may be associated with lateral side 112 of article of footwear 100. In some cases, side walls 324 and 326 may each have a triangular shape, extending upward from lower plate 300 so as to be contiguous with wall 308 on one side while sloping downward toward forefoot region 110. In other embodiments, side wall 324 and side wall 326 may also have any other shapes including, but not limited to: squares, rectangles, various parallelograms or other polygons.

FIG. 8 illustrates an embodiment of wall 308 and side wall 326 in further detail. FIG. 8 is a close-up side view of lower plate 300 in midfoot region 108. In some embodiments, wall 308 and side wall 326 extend upward from lower plate 300 by height 330. In some cases, height 330 may have a value approximately in the range between 0.25 cm and 3 cm. In other cases height 330 may have any other desired value. In some embodiments, angle 362, which is formed between wall 308 and side wall 326, may be a substantially right angle. Side wall 326 slopes downward away from wall 308, and towards forefoot region 100, at angle 342. Angle 342, as shown, is the angle between the horizontal plane of lower plate 300 and side wall top surface 340, and may generally be of any value that is less than 90°. As a result of top surface 340 being so angled, side wall 326 extends a length 338 out from wall 308 toward forefoot region 110. In some cases, length 338 may be on the order of about 0.1 to about 5 cm. In other cases, length 338 may have any other value.

In some embodiments, lateral side wall 326 and medial side wall 324 are substantially symmetric in shape and location about center line 118. In some cases, therefore, the above discussion regarding the height, angles and length of side wall 326 may be equally applicable to side wall 324. However, in other embodiments, side wall 326 and side wall 324 may have different shapes. In one embodiment, as shown in FIG. 8, lateral side wall 326 may include lateral side wall top surface 340, and medial side wall 324 may include medial side wall top surface 341. Furthermore, as shown in FIGS. 7 and 8, each of wall top surface 309, lateral side wall top surface 340 and medial side wall top surface 341 may be substantially coplanar. These three coplanar surfaces may serve to transfer forces from an upper plate (discussed below) to lower plate 300 and outsole 200.

Lower plate 300 may also include a second substantially flat region 303. Second substantially flat region 303 may be located in front of wall 308, and thus also located in midfoot region 108. Second substantially flat region 303 may be divided into a rear flat region 364 and a front flat region 366. Rear flat region 364 may be bounded laterally by the lateral side wall and the medial side wall. Front flat region 366 may be adjacent to rear flat region 364. In some cases, a front edge of front flat region 366 may be contiguous with forward boundary 206 of depressed region 214 in outsole 200.

As briefly mentioned, lower plate 300 may include at least one rib 306. The at least one rib 306 may function to transfer force from a wearer's foot down through to outsole 200, while providing cushioning and resilience. At least one rib 306 may extend from wall 308 towards heel region 106. In the context of the above discussed features, wall 308 and at least one rib 306 may be located between first substantially flat portion 302 and second substantially flat portion 303. In some cases, wall 308 and at least one rib 306 may be located in midfoot region 108.

In some embodiments, the at least one rib 306 extends upward from lower plate 300 and away from wall 308. Moreover, the at least one rib 306 may generally take any suitable shape. In the embodiments shown in FIGS. 7-9, the at least one rib 306 has a triangular shape. Specifically, as shown in FIG. 8, the at least one rib 306 may be aligned such that a substantially right angle 360 of the triangular shape associated with rib 306 is located between wall 308 and lower plate 300. The at least one rib 306 may also be defined by angle 336 between the plane of lower plate 300 and a top surface 334 of the rib's triangular shape. In some cases, angle 336 may be any value less than 90° . In some cases, angle 336 may be about 15° to 45°. At least one rib 306 may also be angled with respect to center line 118, as shown in FIG. 9. Specifically, in some embodiments, at least one rib 306 may be angled outward away from center line 118.

Generally, lower plate 300 may include any number of ribs. In the embodiments shown, lower plate 300 includes multiple ribs. The multiple ribs may be configured in any pattern. For example, lower plate 300 may include a first group 315 of at least one rib, a center rib 316, and a second group 323 of at least one rib. Such embodiments would necessarily include at least three ribs, and may include any suitable number more. In the embodiment shown, first group of at least one rib 315 includes first rib 310, second rib 312 and third rib 314. Center rib 316 may also be referred to as the fourth rib. Also, second group 323 includes fifth rib 318, sixth rib 320, and seventh rib 322.

Each of the ribs discussed above has a respective length. As shown in FIG. 9, first rib 310 may have length 344, second rib 312 may have length 346, third rib 314 may have length 348, center (fourth) rib may have length 350, fifth rib 318 may have length 352, sixth rib 320 may have length 354, and seventh rib 322 may have length 356.

The several ribs may also have certain relationships among them. For example, in some particular embodiments, first group 315 of at least one rib and second group 323 of at least one rib may be symmetric in shape and location about center rib 316. As shown in FIG. 9, the first and second groups of ribs may therefore also be symmetric about center line 118. In other words, in some cases, length 344, length 346 and length 348 may be the same as length 356, length 354 and length 352 respectively. In other cases, the lengths of each rib may be asymmetric with respect to center line 118.

The respective lengths of each rib may also have other relationships to each other. For examples, each rib in first group 315 and each rib in second group 323 may have a respective length, where each respective length may be less than the length of center rib 316. This embodiment is seen in FIG. 9, where each of length 344, length 346, length 348, length 352, length 354 and length 356 are shorter than length 350 of center rib 316. Finally, each respective length of a rib may decrease as a distance between that rib and center rib 316 increases. In other words, ribs located closest to center rib 316 (such as ribs 314 and 318) may have a length (such as length 348 and length 352) that is less than length 350 of center rib 316, while the ribs next farthest away (such as ribs 312 and 320) may have a length (such as length 346 and length 352) that is less than the length of the ribs directly next to center rib 316, and so on. In a similar manner, the degree to which a rib is angled out away from center line 118 may increase as a distance between that rib and center rib 316 increases.

As a result of the above discussed structures, in some embodiments, the ribs may serve to disperse a force applied by a wearer's foot during movement over a broad area of lower plate 300 and outsole 200. To this end, in some embodiments, ribs 306 may be made of a material that is substantially rigid, such a PVA polymer, a polyurethane polymer, or other substantially inflexible polymer material. In other embodiments, ribs 306 could be made of any other material.

Finally, lower plate 300 may also include a ridge 328. Ridge 328 may extend upward from lower plate 300, and ridge 328 may be located between the at least one rib 306 and first substantially flat region 302. In some cases, as shown in FIGS. 7 and 9, ridge 328 may be adjacent to a rearmost end of each rib 306, and may therefore be contoured according to the varying lengths of the several ribs. In some embodiments, ridge 328 may extend from midfoot region 108 back into heel region 106. In some cases, ridge 328 may interact with a heel support system, as discussed below.

FIGS. 10 through 14 illustrate an embodiment of a heel support system.

Article of footwear 100 can include provisions for supporting and absorbing energy or shocks supplied to article of footwear 100 between a wearer's foot and the ground during movement. In some embodiments, article of footwear 100 may include a shock reducing and/or energy absorbing system. In one embodiment, article of footwear 100 may include an energy absorbing system associated with a wearer's heel, as it is often preferable to reduce the shock or energy absorbed directly by a wearer's heel. In some embodiments, heel support system 400 may provide this shock absorption. In some cases, heel support system 400 may compress vertically and deform horizontally in response to force applied by a wearer's heel.

Heel support system 400 may be considered to be part of a midsole in article of footwear 100. Namely, heel support system 400 may be considered to be part of a midsole because heel support system 400 is situated between outsole 200 and upper 102, and includes provisions for absorbing forces applied by a wearer's foot during movement.

Figure 10:
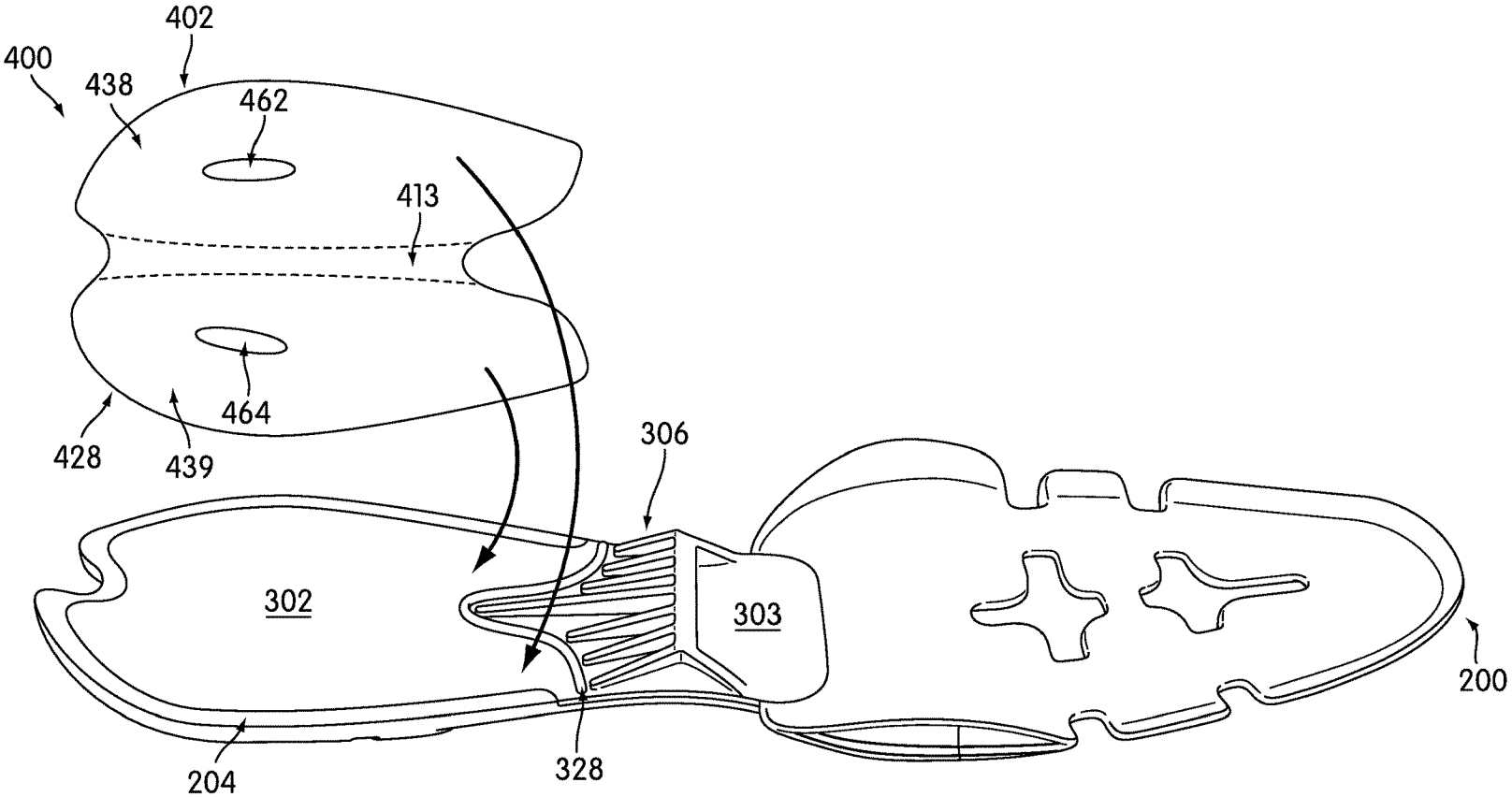
FIG. 10 is an isometric view of the underside of an embodiment of a heel system with the lower plate and outsole.

FIG. 10 is an isometric view of an embodiment of heel support system 400, lower plate 300 and outsole 200. Heel support system 400 may include first heel support member 402 (or support member 402), second heel support member 428 (or support member 428), and thin portion 413 separating them. First heel support structure 402 includes first bottom side 438, while second heel support structure includes second bottom side 439.

First bottom side 438 may include first hole 462, extending up into first heel support member 402 but not through the entirety of first heel support member 402. Similarly, second bottom side 439 may include second hole 464, extending up into second heel support member 428 but not through the entirety of second heel support member 428. As a result of first hole 462 and second hole 464, first heel support member 402 and second heel support member 428 may each be partially hollow.

Figure 11:
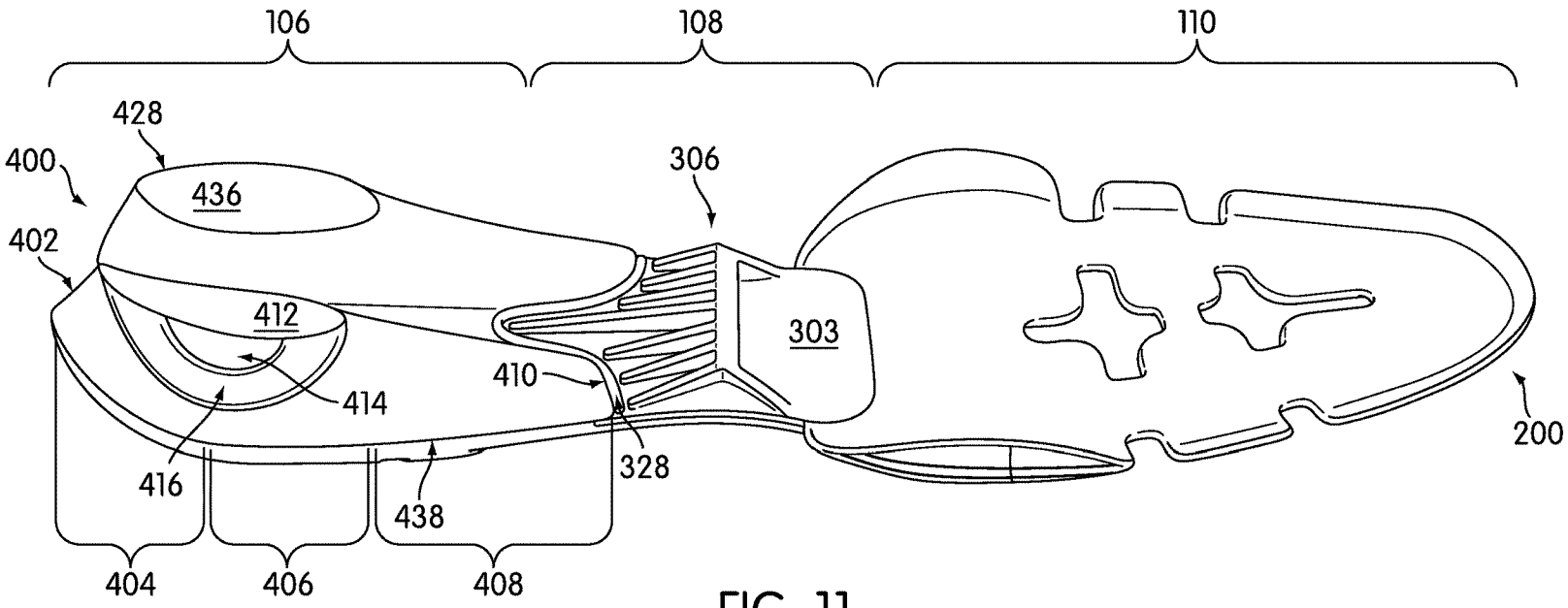
FIG. 11 is an isometric view of an embodiment of the heel system with the lower plate and outsole.

As shown in FIG. 11, heel support system 400 overlaps first substantially flat portion 302 of lower plate 330 and ridge 204 of outsole 200. In some cases, first bottom side 438 and second bottom side 439 are contiguous with first substantially flat portion of 302 of lower plate 330 and ridge 204. Lower plate 300 may therefore be located between heel support system 400 and outsole 200. Heel system 400 is thus located between outsole 200 and upper 102, as well as between lower plate 300 and upper 102.

Heel system 400 may be made up of at least one heel support member 402. Various performance characteristics of article of footwear 100 may be affected by factors such as the shape and material composition of the at least one heel support member 402. For example, the shape and material of the at least one heel support member 402 may determine how forces applied by a wearer's foot are cushioned and transmitted throughout article of footwear 100.

Generally, the at least one heel support member 402 may be comprised of a shock reducing and/or energy absorbing material. Examples of such materials include, but are not limited to, rubber, polyurethane foam, elastic foams, ethyl-vinyl-acetate (EVA) foams such as "phylon", as well as other materials. In one embodiment, the at least one heel support member 402 is made of phylon compressed EVA foam pellets. In other embodiments, heel support member 402 could be made of any other suitable material.

In different embodiments, the rigidity of a heel support member could vary. In some embodiments, heel support member 402 could be more rigid than a standard foam. In other embodiments, heel support member 402 could be less rigid than a standard foam. In still other embodiments, heel support member 402 could have a rigidity approximately equal to the rigidity of a standard foam. A standard foam may include any type of foam known in the art and used with footwear. In some situations, a standard foam may be associated with a foam material used in support members, including any of the materials discussed above. The material properties of heel support member 402 may be selected to achieve any desired rigidity characteristics for heel support member 402.

The shape of the at least one heel support member 402 may be described in a variety of ways. The following descriptions of the shape are generally made with reference to FIGS. 11 through 14. However, it is understood that an embodiment of a support member within the scope of this disclosure may include each of the following descriptions of the shape separately, or any particular subset thereof in combination.

For purposes of describing support member 402, the shape of support member 402 may be characterized by comparing the bottom side with the top side. First heel support member 402 may include first bottom side 438, as mentioned above and shown in FIG. 10, as well as first top side 412 as shown in FIG. 11. First top side 412 may have a first total surface area, while first bottom side may have a second total surface area. In some cases, the second total surface area may be larger than the first total surface area. Such a configuration may allow a force applied by a wearer's heel to be applied to a smaller area (top side 412) and subsequently transmitted and disbursed across a larger area (bottom side 438) in order to delocalize pressure applied to outsole 200 through heel system 400.

Figure 13:
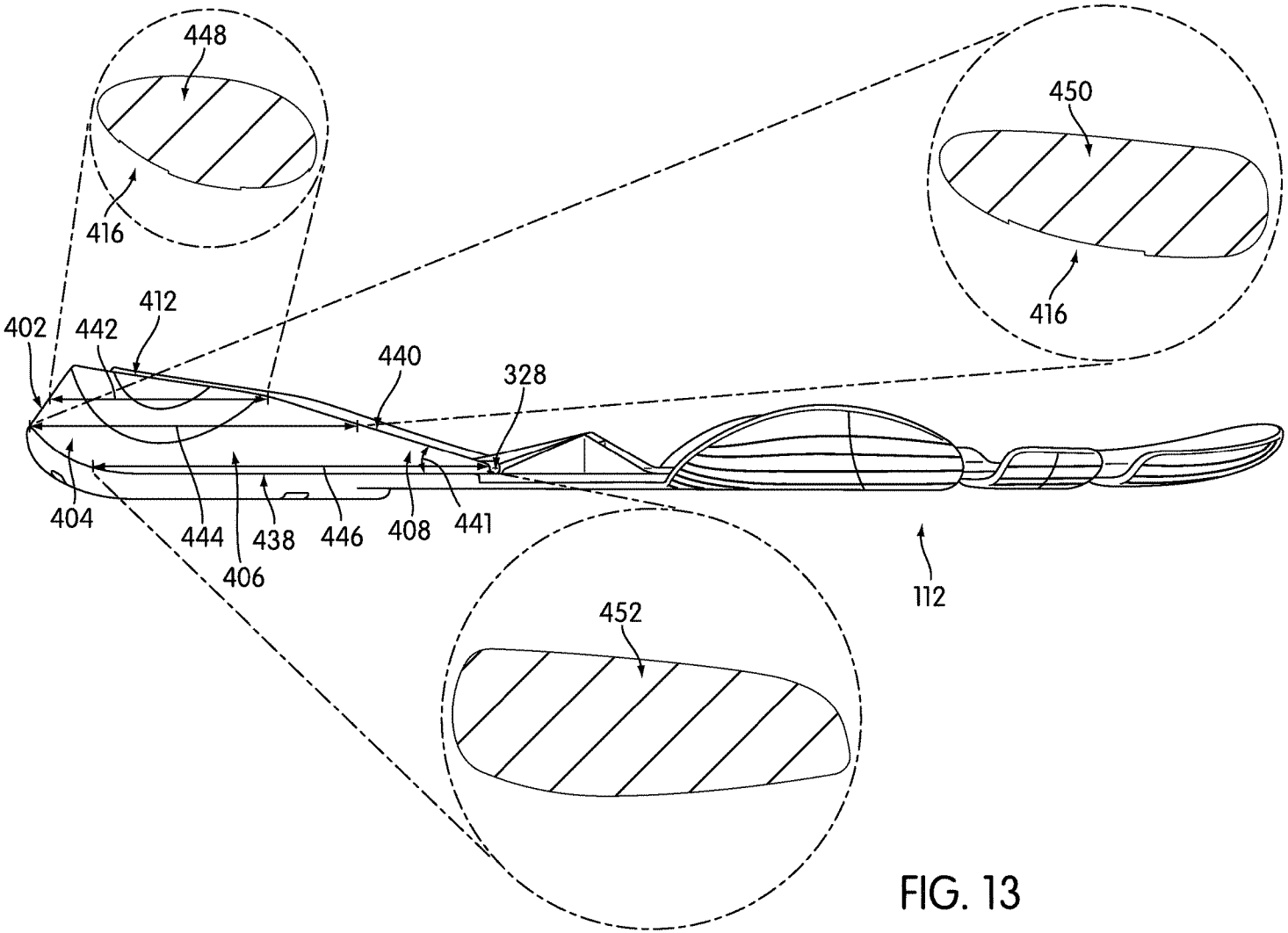
FIG. 13 is a side view of an embodiment of the heel system, including three cross-sectional views, with the lower plate and outsole.

In different embodiments, the length and/or width of support member 402 can vary. In some embodiments, length of heel support member 402 may increase from top side 412 to bottom side 438. In other words, the length may decrease based on the height from bottom side 438. FIG. 13 shows three exemplary lengths taken at three heights along heel support member 402. These exemplary lengths are used to illustrate the relative widths at different heights, not any particular length at any given location. Specifically, a first length 442 may be adjacent to top surface 412, second length 444 may be in the middle of heel support member 402, and third length 446 may be adjacent to bottom side 438. As shown, in the current embodiment, third length 446 is greater than second length 444, which is greater than first length 442. In other embodiments, first length 442, second length 444 and third length 446 can have any other relationship to one another.

Figure 14:
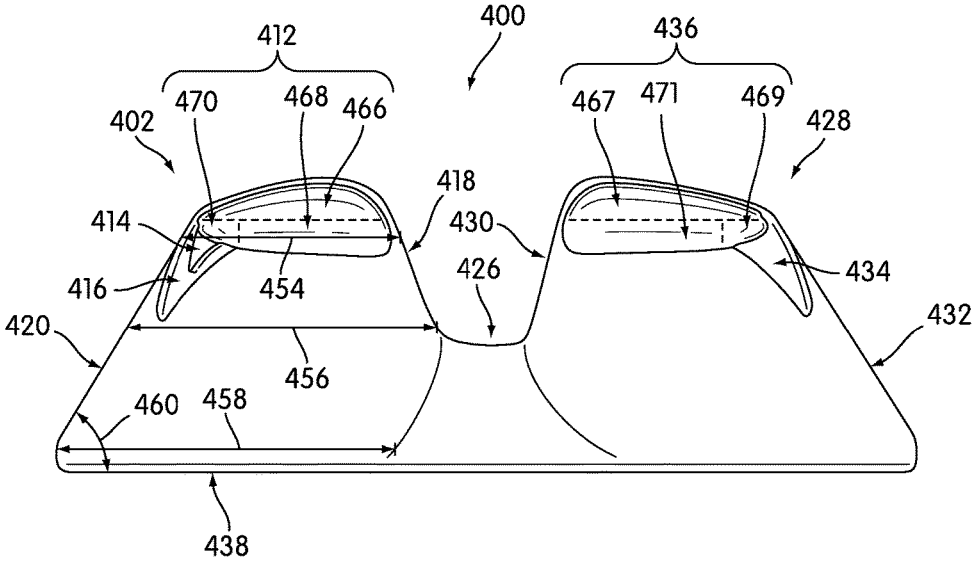
FIG. 14 is a front view of an embodiment of the heel system.

Similarly, in some embodiments, the width of heel support member 402 may increase from top side 412 to bottom side 438. In other words, the width may decrease based on the height from bottom side 438. FIG. 14 shows three exemplary widths, which are again merely illustrative of the relationships among the widths and not indicative of any particular width. Specifically, first width 454 may be adjacent to top surface 412, second width 456 may be in the middle of heel support member 402, and third width 458 may be adjacent to bottom side 438. As FIG. 14 shows, in the exemplary embodiment, third width 438 may be greater than second width 456, which may be greater than first width 454. In other embodiments, first width 454, second width 456 and third width 458 can have any other relationship to one another.

FIG. 13 also shows how the shape of heel support member 402 may be described with reference to a horizontal cross-sectional area at a particular height. The horizontal cross-sectional area of heel support member 402 may increase from top side 412 to bottom side 438. In other words, the horizontal cross-sectional area may decrease based on the height from bottom side 438. FIG. 13 shows three exemplary horizontal cross-sectional areas illustrative of the relationship among the cross-sectional areas. Specifically, first cross-sectional area 448 may be adjacent to top side 412, second cross-sectional area 450 may be in the middle of heel support member 402, and third cross-sectional area 452 may be adjacent to bottom side 438. As shown by the relative sizes of each in FIG. 13, in the exemplary embodiment, third cross-sectional area 452 has a total area that may be greater than that of second cross-sectional area 450, which in turn may be greater than that of first cross-sectional area 448.

In the particular embodiment of FIG. 13, first cross-sectional area is taken at the same height as first length 442, second cross-sectional area 450 is taken at the same height as second length 444, and third cross-sectional area is taken at the same height as length 446. However, in other embodiments, the lengths, cross-sectional areas and also widths may be taken at any particular height along heel support member 402.

Turning back to FIG. 11, heel support member 402 may include three general sections: a rear portion 404, a center portion 406, and a forward portion 408. Each of these section are continuous with the others, but may have different shapes.

First, forward portion 408 may extend forward in such a manner as to extend from heel region 106 to midfoot region 108. Forward portion 408 may generally extend from a front edge of top surface 412 to front edge 410 of the entire heel support structure 402. Forward portion 408 may include an angled top surface 440, as shown in FIG. 13, which may be disposed at an angle 441 with respect to bottom surface 438. In some cases, angle 441 may be any angle less than 90°. In some cases angle 441 may be between about 10° and 80°. In still other cases, angle 441 may be between about 10° and about 30°. With this arrangement, forward portion 408 and angled top surface 440 may serve to diffuse a force applied by a wearer's heel to top surface 412 through heel region 106 and into midfoot region 108.

Figure 12:
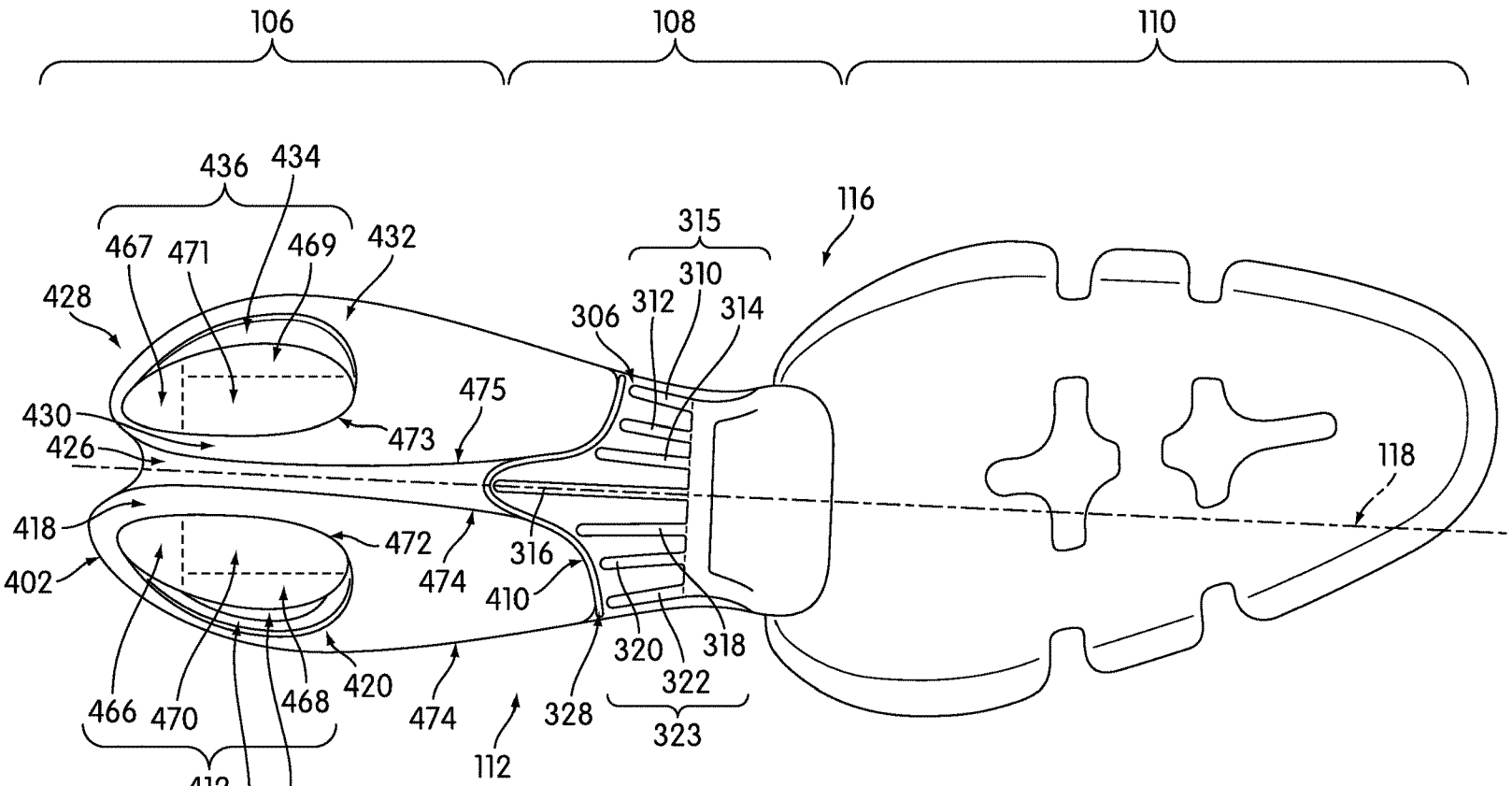
FIG. 12 is a top view of an embodiment of the heel system with the lower plate and outsole.

In some embodiments, forward portion 408 may interact with features of lower plate 300. In some cases, lower plate ridge 328 may be contiguous with front edge 410 of forward portion 408. Ridge 328 may therefore be located between forward portion 408 and at least one rib 306. FIGS. 11 through 13 show how ridge 328 may abut forward portion 408. In particular, as shown in FIG. 13, forward portion 408 may taper to a height at front edge 410 that is substantially equal to a height of ridge 328.

Rear portion 404 is shown in FIGS. 11 and 13, and may be curved vertically upward. In some cases, rear portion 404 may be curved upward at an angle of between about 10° and about 70° with respect to bottom surface 438. In other cases, rear portion 404 may be curved upward at an angle between about 20° and about 50° with respect to bottom surface 438. In still other cases, rear portion 404 may be curved upward at an angle between about 25° and about 35° with respect to bottom surface 438. In one embodiment, rear portion 404 may be curved at an angle of about 30° with respect to bottom surface 438. This curvature of rear portion 404 may aid article of footwear 100 in rolling forward during a heel strike portion of a running movement.

As discussed above, heel support member 402 may include hole 462 (see FIG. 10) on bottom side 438. Hole 462 may be located in center portion 406. Therefore, in some cases, center portion 406 may be at least partially hollow. This feature may be included for reasons such as reducing the total weight of heel system 400, or controlling how heel support member 402 compresses in response to forces applied by a wearer's foot.

As seen in FIGS. 12 and 14, heel support member 402 may include an inner side 418 and an outer side 420. The terms "inner" and "outer" are used with respect to center line 118 of article of footwear 100, such that inner side 418 is closer to center line 118 while outer side 420 is farther away. Each of inner side 418 and outer side 420 may be substantially non-vertical. In other words, for example, outer side 420 may be disposed at angle 460 with respect to bottom side 438. In some embodiments, angle 460 may be between 40° and 80° with respect to bottom side 438. Inner side 418 may be disposed at a similar angle as angle 460, or a different angle. These angles result from the increase in width as function of height, as discussed above and as shown in FIG. 14.

The shape of heel support member 402 may also be described with reference to the perimeters of top side 412 and bottom side 438. Specifically, top side 412 may include top perimeter 472, and bottom side 438 may include bottom perimeter 474, both as shown in FIG. 12. In some cases, top perimeter 472 may be smaller than bottom perimeter 474. In some embodiments, top perimeter 472 may be located within a vertical boundary defined by bottom perimeter 474. In other words, top perimeter 472 may be contained within the bounds of bottom outer perimeter 474, such that top perimeter 472 is smaller than (and non-overlapping with) bottom perimeter 474.

As a result of the various shapes described above, heel support member 402 may supply additional cushioning and more flexibility over traditional heel support structures such as vertical columns. In some cases, the use of these shapes may allow the use of a softer material than could otherwise be used in known heel support structures, thus resulting in a softer feel to a wearer's foot. Furthermore, by varying the several aspects of the shape (such as length, width, forward portion angle, etc.) various deformation properties of heel system 400 may be modified, resulting in different cushioning and flexibility properties.

Heel system 400 may further include a second heel support member 428. Although the above discussion mentioned a variety of features with respect to heel support member 402, these features may also generally be embodied by any of multiple heel support members within heel system 400. The number of heel support members included in heel system 400 is not particularly limited, and heel system 400 may include as many distinct heel support members as may be desired to achieve preferred performance characteristics.

FIGS. 12 and 14, in particular, show details of an embodiment of heel system 400 including first heel support member 402 as well as second heel support member 428. Second heel support member 428 may have widths, lengths, and cross-sectional areas as were discussed above with respect to first heel support member 402. In particular, second heel support member 428 may have the same relationships among its width, length and cross-sectional areas while having different values thereof, or may have the same relationships and same values, as first support member 402.

Each of the features of second heel support member 428 may be similar, but differ in dimension or magnitude, or may be substantially the same as each of the features of first heel support member 402. Specifically, second heel support member 428 may include second top surface 436, second bottom surface 439, second inner side 430, second outer side 432, second top perimeter 473 and second bottom perimeter 475, which may each be configured in the same manner as or differently than the corresponding feature on first heel support member 402. Furthermore, first heel support member 402 and second heel support member 428 may have similar relationships to other components in sole 104. For example, first bottom side 438 and second bottom side 439 may each be contiguous with first substantially flat portion 302 of lower plate 300.

In some embodiments, first heel support member 402 and second heel support member 428 may have substantially similar shapes while being symmetric. Specifically, first heel support member 402 and second heel support member 428 may be symmetric about a center line 118 of article of footwear 100. In other words, first heel support member 402 and second heel support member 428 may be mirror images of each other.

In some embodiments, first heel support member 402 and second heel support member 428 may be aligned within heel system 400 in a particular relationship. For example, first heel support member 402 may be associated with lateral side 112 of article of footwear 100, while second heel support member may be associated with medial side 116. Heel system 400 may further include an empty space 426 between first heel support member 402 and second heel support member 428.

In embodiments where first heel support member 402 and second heel support member 428 are aligned in a particular relationship within heel system 400, each of first heel support member 402 and second heel support member 428 may also be aligned in particular relationships with ribs 306 on lower plate 300. As seen in FIG. 12, first group of ribs 315 is adjacent to second heel support member 428, and second group of ribs 323 is adjacent to first heel support member 402, while center rib 316 is adjacent to space 426 between first heel support member 402 and second heel support member 428. Furthermore, ridge 328 may be located between both of first heel support member 402 and second heel support member 428 and ribs 306. Ridge 328 accordingly may be contiguous with forward portion 408 of first heel support member 402, and contiguous with a forward portion of second support member 428.

Top surface 412 on first heel support member 402 was discussed in isolation above. However, in the context of the dual structure of first heel support member 402 and second heel support member 428, first top surface 412 and second top surface 436 may include additional features that aid in achieving desired performance characteristics. In particular, first top side 412 and second top side 436 may be configured to direct a force applied by a wearer's heel in a particular direction relative to article of footwear 100.

For example, first top side 412 and second top side 436 may be configured to direct a force applied by a wearer's heel toward center axis 118 of the article of footwear. This feature may enable article of footwear 100 to be more stable, because this feature may reduce the likelihood that the force of a wearer's weight would be applied to an outer edge of outsole 200.

Similarly, first top side 412 and second top side 436 may be configured to direct a force applied by a wearer's heel toward mid-foot region 108 of article of footwear 100. This feature may enable article of footwear 100 to achieve better resilience, and therefore improve the energy efficiency of article of footwear 100, in conjunction with the variously discussed shapes of the heel support members.

First top surface 412 may include first rear surface region 466, first peripheral surface region 468, and first center surface region 470, as shown in FIGS. 12 and 14. Also, second top surface 436 may include second rear surface region 467, second peripheral surface region 469, and second center surface region 471. In some cases, the regions of first top surface 412 and second top surface 436 may be configured in a symmetric manner. First peripheral surface region 468 may be associated with lateral side 112 of article of footwear 100, while second peripheral surface region 469 may be associated with medial side 116 of article of footwear 100.

Each of first peripheral surface region 468 and second peripheral surface region 469 may be curved upward, just as each of first rear surface region 466 and second rear surface region 467 may also be curved upward. Conversely, first center surface region 470 and second center surface region 471 may be substantially flat. This curvature along the peripheral edges may serve to direct force toward center line 118, while this curvature along the rear edges may serve to direct force forward toward midfoot region 108.

In some embodiments, the curvature of the peripheral edges may vary along their length. Specifically, first peripheral surface region 468 may curve upward to a greater degree closer to first rear surface region 466. FIG. 14 shows these features in greater detail. This variation in curvature may be gradual, so that the curved edge of first peripheral surface region 468 is continuous with the curved edge of first rear surface region 466. In some embodiments, second peripheral surface region 469 may also be curved in this manner.

Although first heel support member 402 and second heel support member 428 may be substantially symmetric in shape, they may also include at least one feature that is not symmetric between them. Specifically, each of first heel support member 402 and second heel support member 428 may include an indentation in an outer side thereof. These indentations are discussed below with respect to upper plate 500.

Figure 15:
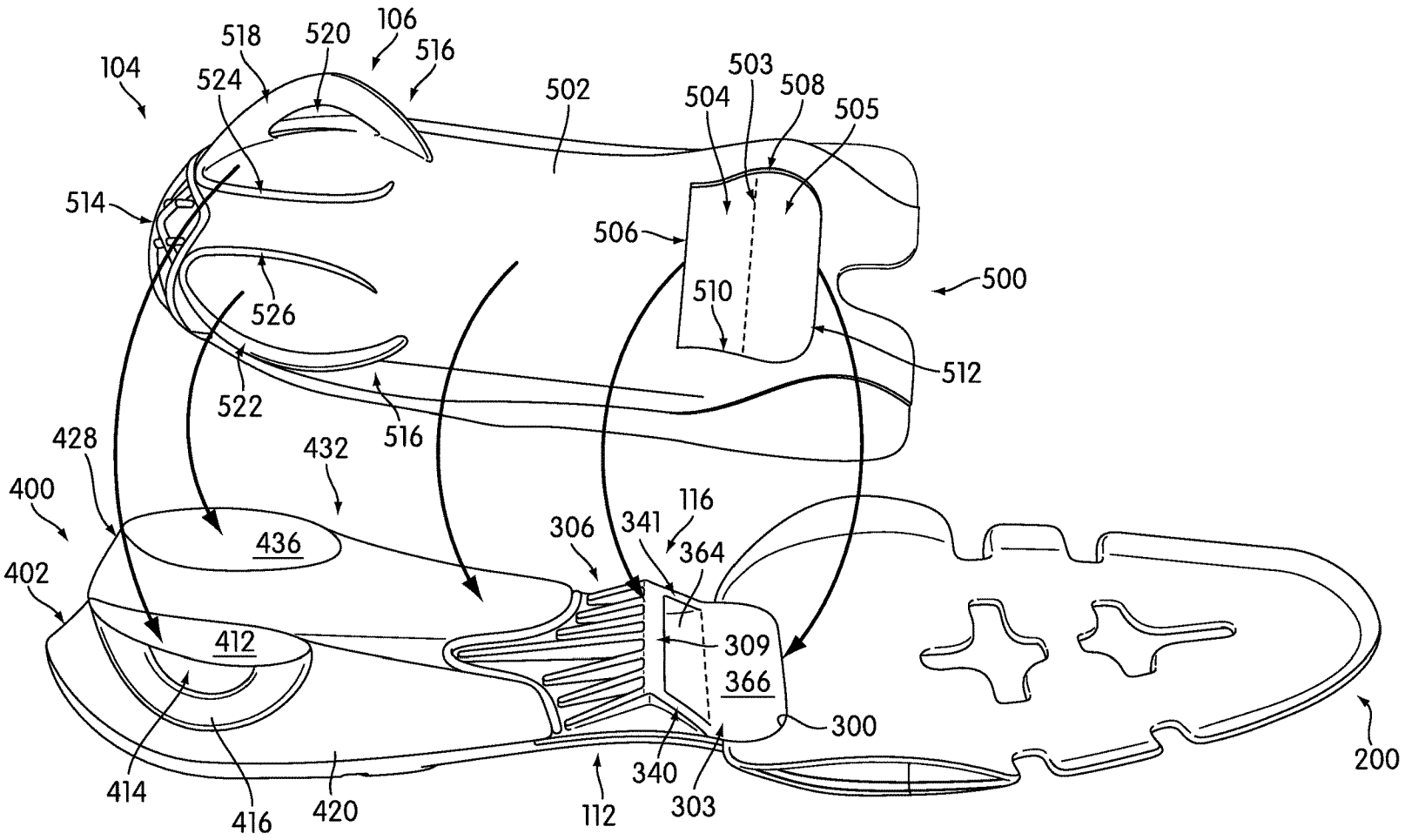
FIG. 15 is an isometric view of the underside of an embodiment of an upper plate, with the heel system, lower plate and outsole.

FIG. 15 shows a bottom view of upper plate 500, along with an isometric view of some components of sole 104 including outsole 200, lower plate 300 and heel system 400. Broadly, upper plate 500 may be any plate that is located between a midsole and an upper. Accordingly, it is noted that heel system 400 may be located between upper plate 500 and outsole 200, as well as between upper plate 500 and lower plate 300. In particular, upper plate 500 may be contiguous with heel system 400, such that upper plate 500 is located between heel system 400 and upper 102 (see FIG. 1) in heel region 106. Upper plate 500 may also be contiguous with lower plate 300 in midfoot region 108. In the particular embodiment shown, upper plate 500 may be aligned as indicated schematically by the several arrows in FIG. 15. Specifically, first top side 412 and second top side 436 may each be contiguous with lower surface 502 of upper plate 500, as indicated.

Figure 16:
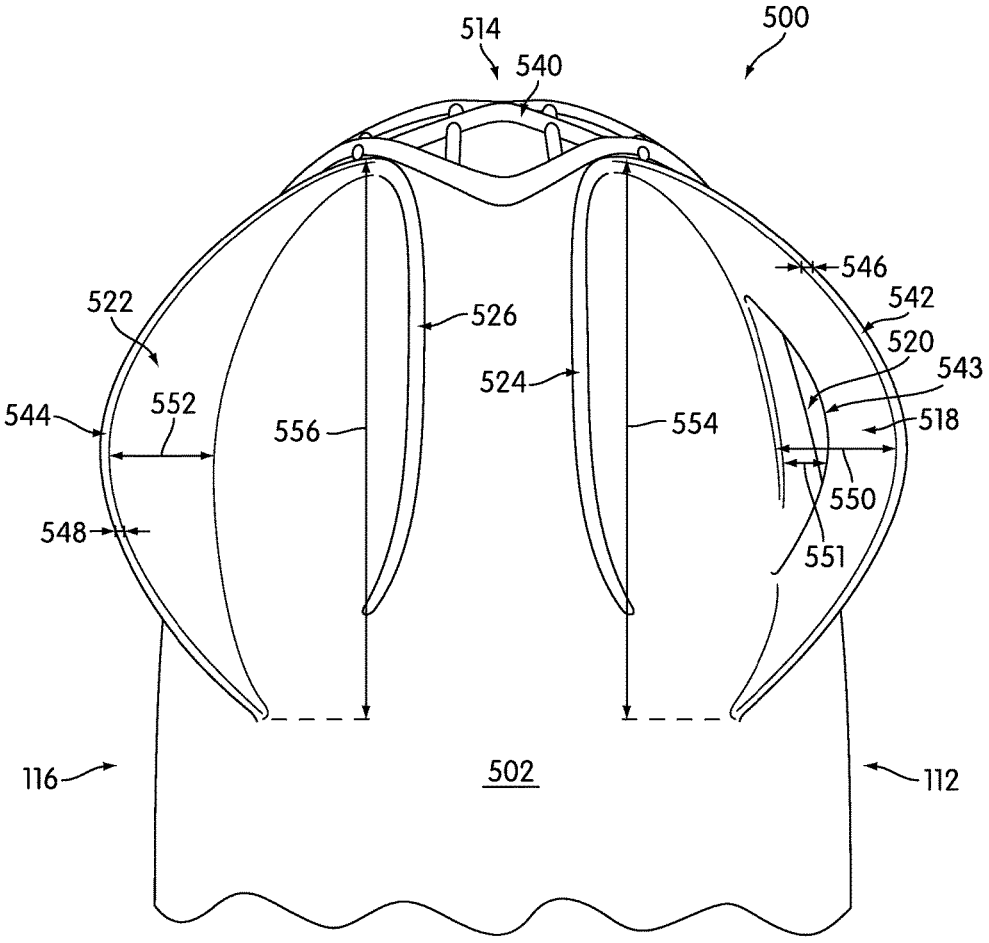
FIG. 16 is a close-up view of an embodiment of a portion of the underside of the upper plate.

Upper plate 500 may include a variety of features that interact with other components of sole 104. In particular, upper plate 500 may include lateral side flap 518 and medial side flap 522, as shown in FIGS. 15 and 16. These side flaps may be lateral/medial asymmetric, and may be configured to cause lateral side 112 of article of footwear 100 to respond differently than medial side 116 to forces applied by a wearer's foot. In particular, the side flaps may restrain horizontal deformation of a midsole, so that one side (either lateral side 112 or medial side 116) deforms in a horizontal direction to a lesser degree. Since the degree of horizontal deformation of a midsole may be related to its stiffness, the side flaps may enable one side of a midsole to be effectively stiffer than the other.

Lateral side flap 518 and medial side flap 522 may each be located in heel region 106 of upper plate 500. Lateral side flap 518 and medial side flap 522 may each also extend downward from upper plate 500, so as to generally overlap a midsole on each side of article of footwear 100. In the embodiment shown in FIGS. 15 through 17, lateral side flap 518 overlaps outer side 420 of first support member 402, and medial side flap 522 overlaps outer side 432 of second heel support member 428.

In some embodiments, lateral side flap 518 and medial side flap 522 may be asymmetric. Generally, lateral side flap 518 may have a first horizontal stiffness. The term horizontal stiffness is understood to mean resistance to deformation, and may be measured as an elastic modulus such as the Young's modulus, as is commonly known in the art of mechanical engineering. Medial side flap 522 may then have a second horizontal stiffness. In some embodiments the second horizontal stiffness may be different from the first horizontal stiffness. In some embodiments, the second horizontal stiffness may be greater than the first horizontal stiffness. In other embodiments, the second horizontal stiffness may be less than the first horizontal stiffness. In still other embodiments, the first horizontal stiffness and the second horizontal stiffness can be substantially equal.

This difference in horizontal stiffness may be achieved in a variety of ways. For example, the flaps may be made from different materials. Alternatively, lateral side flap 518 and medial side flap 522 may be asymmetric in shape. For example, lateral side flap 518 may have a first shape, while medial side flap 522 may have a second shape that is different from the first shape. The particular shape may generally take any form, so long as the shapes are sufficiently different so as to affect how a midsole horizontally deforms. For example, one flap may be longer, wider, thicker, or cover a larger total area than the other.

Figure 17:
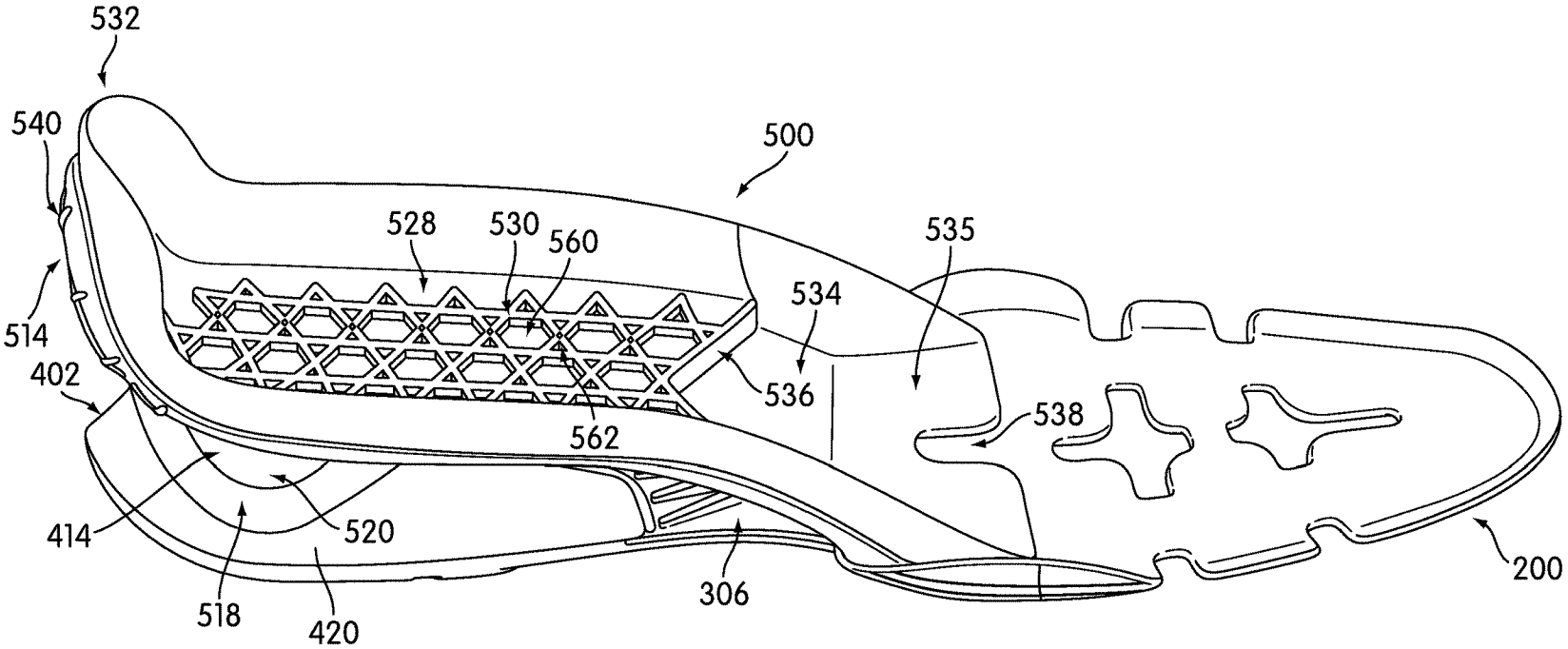
FIG. 17 is an isometric view of an embodiment of the upper plate, with the heel system, lower plate and outsole.

In the embodiment shown in FIGS. 15 through 17, lateral side flap 518 and medial side flap 522 are different in shape. Specifically, lateral side flap 518 may have a shape defined by an area between a distal edge 542 and a proximal edge 543, as seen in FIG. 16. Specifically, lateral side flap 518 may be in the shape of a band attached to lower surface 502 of upper plate 500 at each end. Distal edge 542 of lateral side flap 518 may extend distance 550 away from lower surface 502 of upper plate 500, while proximal edge 543 may extend distance 551 away from lower surface 502. Lateral side flap may also be defined by length 554 and thickness 546. Between proximal edge 543 and lower surface 502, lateral side flap 518 includes 520 window extending there through.

In contrast, medial side flap 522 may be defined by an area between distal edge 544 and lower surface 502 of upper plate 500. This area is continuous, and extends distance 552 away from lower surface 502. Medial side flap 522 may also defined by length 556, and thickness 548. In the embodiment shown in FIG. 16, length 554 and length 556 may be substantially similar, thickness 546 and thickness may be substantially similar, and distance 550 and distance 552 may be substantially similar. Accordingly, the primary difference between lateral side flap 518 and medial side flap 522 is the presence of window 520 in lateral side flap 518. However, in other embodiments, each of the lengths, thicknesses or distances may be different from each other. Any combination of these features, or other features, may be the same or different from one side flap to the other, in order to achieve a difference in horizontal stiffness.

An area of lower surface 502 of upper plate 500 between lateral side flap 518 and lateral inner ridge 524 may be configured to be contiguous with top surface 412 of first heel support member 402. In the same manner, an area of lower surface 502 between medial side flap 522 and medial inner ridge 526 may be configured to be contiguous with second top surface 436 of second heel support member 436. These areas of lower surface 502 are shown in FIG. 16, and the alignment between upper plate 500 and heel system 400 is indicted in FIG. 15.

Upper plate 500 may be overlaid on top of heel system as shown in FIG. 17. In such embodiments, as mentioned, lateral side flap 518 may overlap outer side 420 of first support member 402, and medial side flap 522 may overlap outer side 432 of second heel support member 428 (see FIG. 20). Furthermore, first heel support member 402 may include an indentation 416 that may correspond in shape to the shape of lateral side flap 518 on outer side 420. Indentation 416 is shown in FIGS. 14 and 15. Second heel support member 428 may similarly include an indentation 434 on outer side 432 that may correspond in shape to medial side flap 522. Indentation 434 is shown in FIG. 14. These indentations may allow the side flaps to be securely attached to each outer side of each heel support member, so as to aid the flaps in performing their function of restraining horizontal deformation of the heel support members.

As mentioned, lateral side flap 518 includes window 520 therein. As a result of the shape of lateral side flap 518 including window 520, outer side 420 of first support member 402 may include corresponding portion 414 that is not indented. Therefore, as shown in FIG. 17, when lateral side flap 518 overlaps first heel support member 402, portion 414 may extend through window 520. Portion 414 may accordingly not be restrained from horizontal deformation, while portion 416 may be so restrained from horizontal deformation resulting from forces applied by a wearer's heel during movement. In contrast, the entirety of indentation 434 on second heel support member 428 may be restrained from horizontal deformation.

Broadly in the art of footwear, a midsole may have a certain vertical stiffness value that determines how much cushioning and resilience the midsole exhibits. If the midsole is symmetric in structure about its lateral and medial sides, then the lateral side will generally deform to the same degree as the medial side. However, as a result of the difference in horizontal stiffnesses between lateral side flap 518 and medial side flap 520, lateral side 112 of a midsole may have a different effective vertical stiffness than medial side 116, even when the midsole itself is otherwise symmetric.

In the embodiment shown, lateral side flap 518 may restrain horizontal deformation of first heel support member 402 so as to cause first heel support member 402 to have a first effective vertical stiffness value. On the other hand, medial side flap 522 may restrain horizontal deformation of second heel support member 428 so as to cause second heel support member 428 to have a second effective vertical stiffness value. In some embodiments, the second effective vertical stiffness value may be different from the first effective vertical stiffness value. In some cases, the second effective vertical stiffness value may be greater than the first effective vertical stiffness value. However, in other embodiments than those shown, second effective vertical stiffness value may be less than the first effective vertical stiffness value. In both cases, the presence of any side flap may increase the effective vertical stiffness value as compared to the actual vertical stiffness value of the midsole itself without a side flap. In still other embodiments, the first effective vertical stiffness can be approximately equal to the second effective vertical stiffness.

Figure 20:
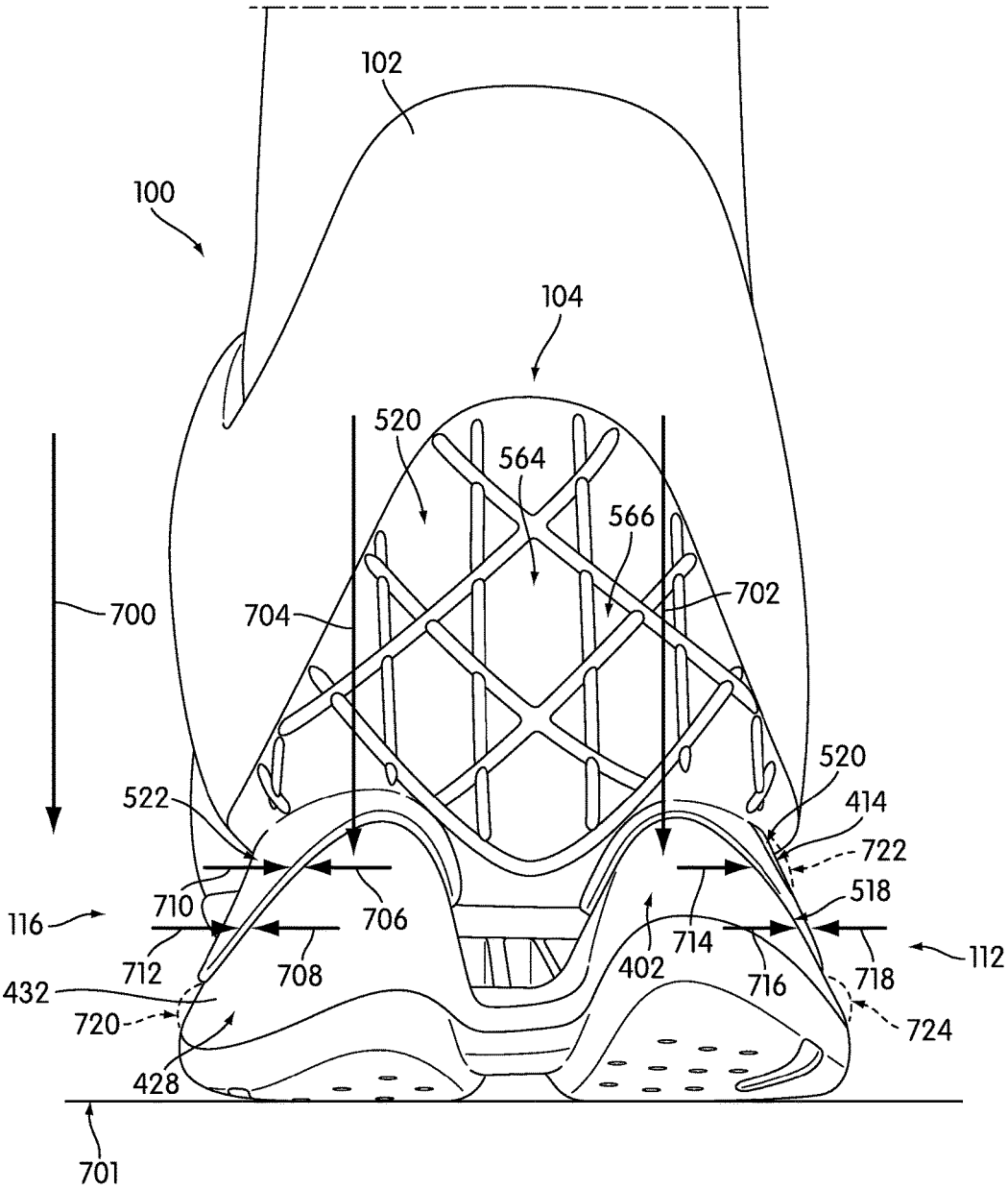
FIG. 20 is a rear view of an embodiment of the article of footwear being worn by a wearer during movement.

FIG. 20 shows representative embodiments of these features in action. Namely, FIG. 20 is a rear view of article of footwear 100 during a heel strike motion of forward movement. A wearer's heel applies force 702 to first heel support member 702, and applies force 704 to second heel support member 428, as article of footwear 100 is moved downward 700 into contact with ground surface 701. As a result of these forces, each heel support member may compress vertically and deforms horizontally. However, they may do so differently because of the differences between lateral side flap 518 and medial side flap 522.

Specifically, as a result of downward force 702, first heel support member 402 experiences representative upper outward force 714 and representative lower outward force 716. Upper outward force 714 causes first heel support member 402 to expand outward horizontally through window 520 at portion 414, as indicated by dashed line 722. Lower outward force is at least partially restrained by lateral side flap 518, as shown by restraining force 718. Outward forces then cause first heel support member 402 to expand outward horizontally in portions not overlapped by lateral side flap 518, as indicated by dashed lines 724.

Similarly, second heel support member 428 experiences upper outward force 706 and lower outward force 708 as a result of downward force 704. However, here upper outward force 706 is at least partially restrained by medial side flap 522, as shown by upper restraining force 710. Therefore, no deformation occurs in an upper region of the outer side of second heel support member 428. Lower outward force 708 is also restrained by medial side flap 522 (as shown by lower restraining force 712), in a similar fashion as lower outward force 716 is restrained by lateral side flap 518. Outward forces then cause second heel support member 428 to expand outward horizontally in portions not overlapped by medial side flap 522, as indicated by dashed lines 720. Accordingly, second heel support member 428 may experience less horizontal deformation than first heel support member 402.

In this way, the performance characteristics of each side of a midsole may be controlled so as to achieve a desired effect. For example, these features may be used to achieve pronation control, or other stability effects. Specifically, in the embodiment shown in FIG. 20, second heel support member 428 on medial side 116 will have a higher effective vertical stiffness because more of its horizontal deformation is restrained. Therefore, this increased effective vertical stiffness on medial side 116 may be helpful in preventing excessive inward rolling of the foot during movement.

With reference back to FIG. 15, upper plate 500 may also include features that interact with lower plate 300. For example, wall top surface 309 on lower plate 300 may be contiguous with upper plate 500, specifically with lower surface 502. In other embodiments, upper plate 300 may be contiguous with each of wall top surface 309, lateral side wall top surface 340, and medial side wall top surface 341. Such embodiments may allow forces applied by a wearer's arch during movement to be transmitted through upper plate 500 and down into wall 308 and ribs 306.

Figure 21:
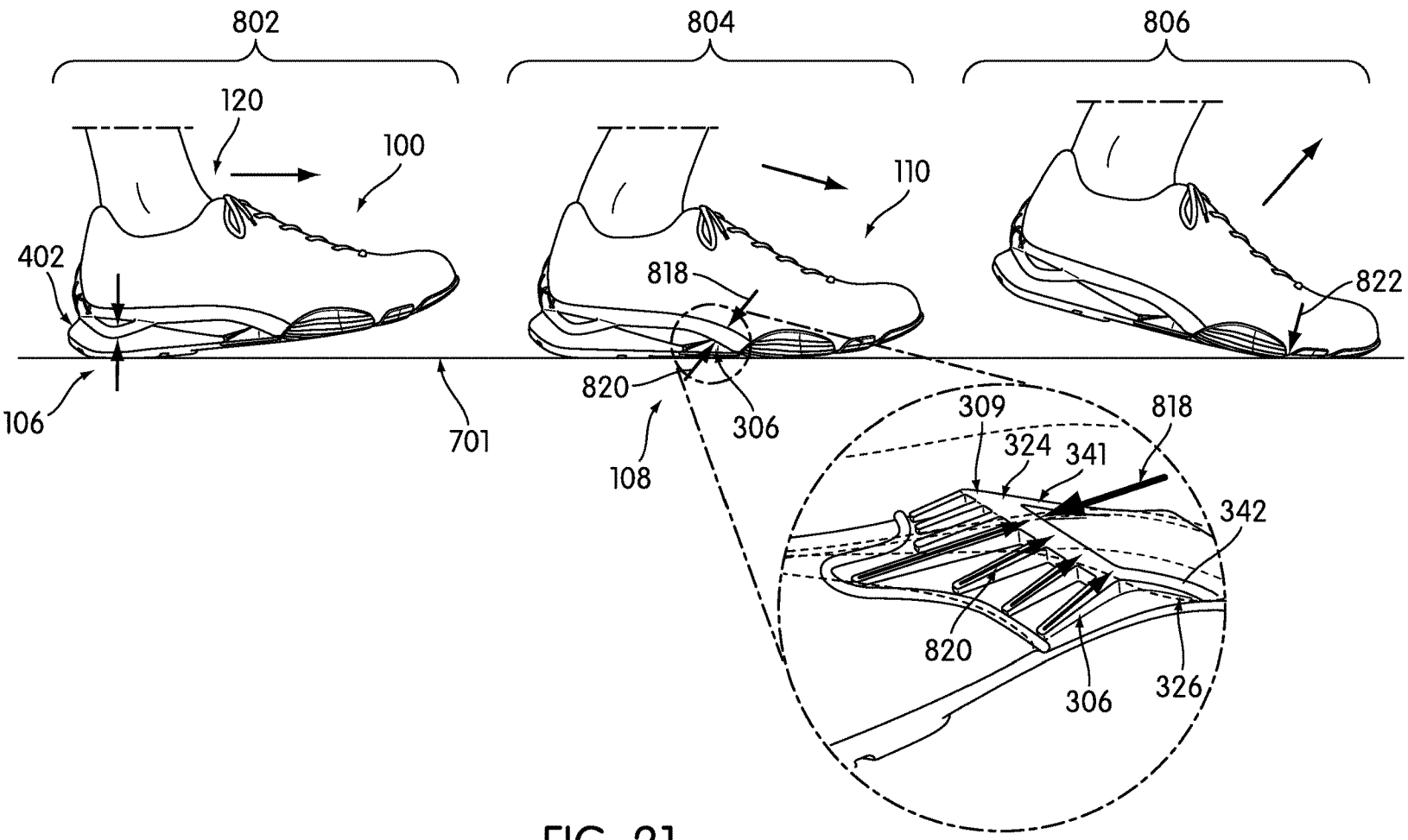
FIG. 21 illustrates three side views of an embodiment of the article of footwear being worn by a wearer during movement, and one close-up view of a portion of the lower plate.

FIG. 21 shows these features of upper plate 500 with lower plate 300 in action. FIG. 21 shows three major stages of movement. First, in stage 802 heel region 106 strikes ground surface 701. Stage 802 is also shown in FIG. 20, and was described above. Next, in stage 804 foot 120 rolls forward such that midfoot region 108 and forefoot region 110 contact ground surface 701. Finally, in stage 806 heel region 106 leaves the ground, and foot 120 rolls forward such that the toes make contact with ground surface 701 so as to liftoff from ground surface 701 and complete the cycle with respect to that foot.

In stage 804 in particular, a wearer's foot 120 applies force 818 downward through upper plate 500 and into lower plate 300. An enlarged view of stage 804 in FIG. 21 shows this process in further detail. Specifically, force 818 is applied downward and rearward by a wearer's arch. Wall top surface 309, lateral side wall top surface 340, and medial side wall top surface 341 may be substantially coplanar. This plane may be disposed at an angle that is substantially equal to the angle at which force 818 is applied by the wearer's foot 120. Accordingly, force 818 may be transferred from wall top surface 309, lateral side wall top surface 340, and medial side wall top surface 341 through to ribs 306 on the opposite side of wall 308. Ribs 306 may be substantially rigid, and therefore resist substantial deformation as shown by resistance force 820. These resistance forces 820 may thereby cause the arch portion 108 of article of footwear 100 to be resilient. Accordingly, ribs 306 in conjunction with wall 308 and side walls 324 and 326 may offer a lightweight mechanism for efficient energy transfer during movement.

Additionally, upper plate 500 may also contact other portions of lower plate 300. As indicated in FIG. 15, lower surface 502 of upper plate 500 may contact second substantially flat region 303 on lower plate 300. As mentioned above, second substantially flat region 303 may be divided into a rear flat region 364 and a front flat region 366. Rear flat region 364 is bounded by lateral side wall 326 and medial side wall 324. With this arrangement, upper plate 500 may not substantially come into contact with rear flat region 364 because the raised side walls are contacted instead. Front flat region 366, on the other hand, may be contiguous with upper plate 500.

In certain embodiments, upper plate 500 may include recess 503 on lower surface 502, as seen in FIG. 15. Recess 503 may aid in securing upper plate 500 to lower plate 300. Specifically, recess 503 may include a rear portion 504 that is shaped so as to be contiguous with wall top surface 309, lateral side wall top surface 340, and medial side wall top surface 341. Namely, rear portion 504 may have a boundary shape defined by rear side 506, lateral side 508 and medial side 510 that is at least partially the same shape as a perimeter of wall top surface 309, lateral side wall top surface 340, and medial side wall top surface 341.

Additionally, recess 503 may include front portion 505 that may be shaped so as to be contiguous with front flat portion 366 of lower plate 300. Front portion 505 may have a shape defined by front side 512, lateral side 508 and media side 510.

Upper plate 500 may also include other features not directly related to other components of sole 104, but that aid in the structure and function of upper plate 500 itself. For example, upper plate 500 may include reinforcing struts 530 on an upper side 528 of upper plate 500. Reinforcing struts 530 are shown in FIG. 17. Struts 530 may provide additional stiffness while enabling upper plate 500 to be lightweight. Struts 530 may take a variety of patterns, and in one embodiment may be arranged in a pattern of interlocking hexagons 560 and triangles 562. This pattern may provide a desired level of stiffness, so that upper plate 500 does not substantially deform in response to forces applied by a wearer's foot.

Similar reinforcing structures may be located on other regions of upper plate 500. For example, upper plate 500 may include a heel cup 532 as shown in FIG. 17. Struts 540 may be located on a rear face 514 of heel cup 532. Struts 540 are shown in detail in FIG. 20, and may also be arranged in a pattern of interlocking hexagons 564 and triangles 566.

In some embodiments, heel cup 532 could include provisions for improving ventilation. In some cases, for example, heel cup 532 could include one or more holes. In different embodiments, the number and/or size of the holes could vary. Also, in some cases, the locations of one or more holes on heel cup 532 could vary. For example, in one embodiment, one or more holes could be disposed between struts 540. By providing one or more holes on heel cup 532, ventilation to the heel portion of a foot may be improved. In other embodiments, however, heel cup 532 may not include any holes. For example, in the embodiment shown in the Figures, heel cup 532 does not include any holes.

As discussed above, upper plate 500 may be made of any substantially non-deforming material. In particular embodiments, upper plate 500 may be made of a translucent or transparent material, as opposed to an opaque material.

Figure 18:
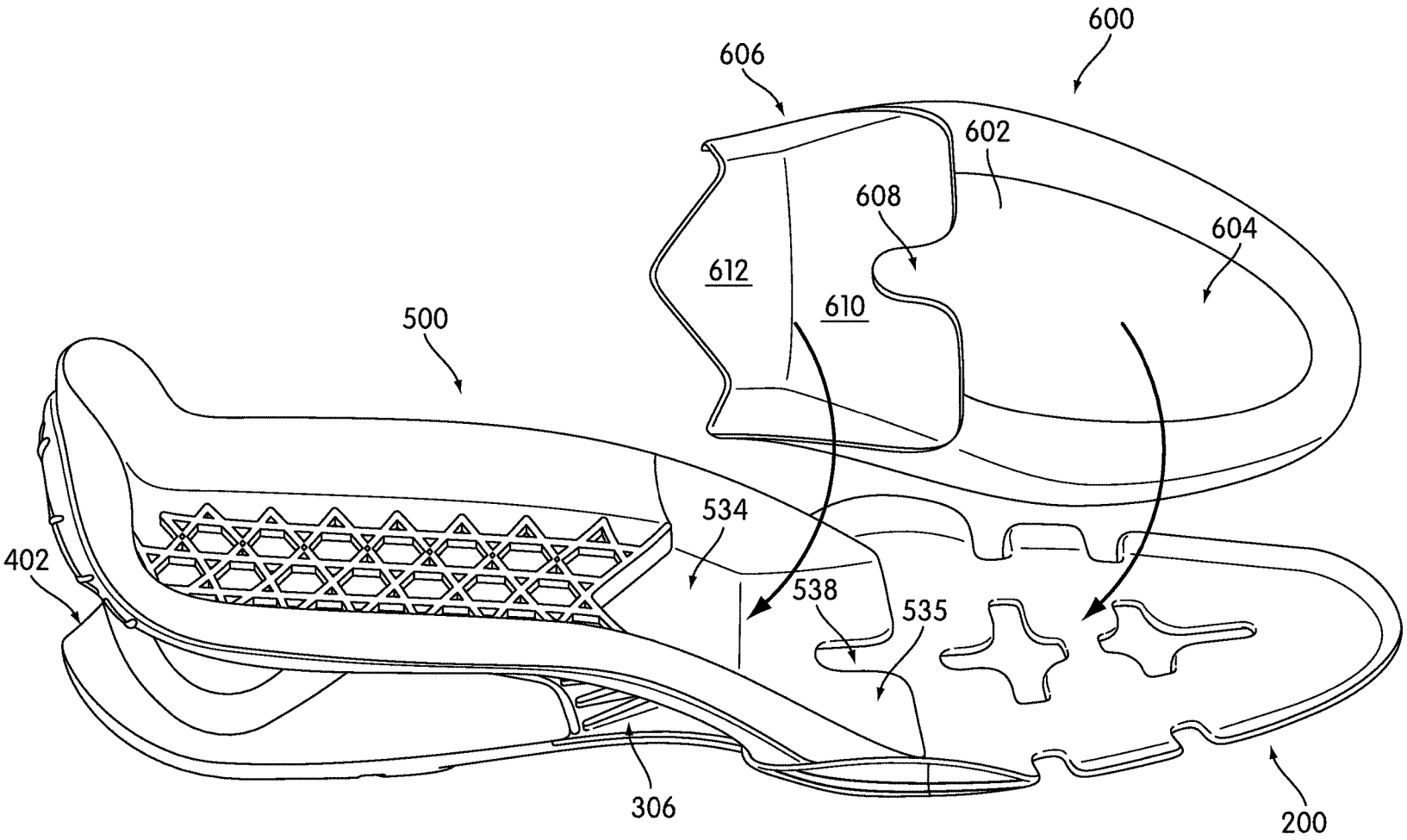
FIG. 18 is an isometric view of the underside of an embodiment of a forefoot plate, with the upper plate, heel system, lower plate and outsole.

Upper plate 500 may include features that enable it to interact with forefoot plate 600. As shown in FIGS. 17 and 18, upper plate 500 may include a wall 536 separating struts 530 from a forward region 534 and substantially flat region 535. Substantially flat region 535 may include a groove 538 that interfaces with a corresponding notch 608 on forefoot plate 600.

FIG. 18 shows a bottom view of forefoot plate 600 along with an isometric view of the remaining components of sole 104. Forefoot plate 600 may include bottom surface 602, which may include forward region 604 and rear region 606. Rear region 606 may be configured to be contiguous with regions 534 and 535 of upper plate 500. Specifically, rear region may include surface 610 that may be configured to be contiguous with region 535 on upper plate 500, and may also include surface 612 that may be configured to be contiguous with region 534 on upper plate 500. Notch 608 may be included in forward region 604, at the boundary between rear region 606 and forward region 604.

Figure 19:
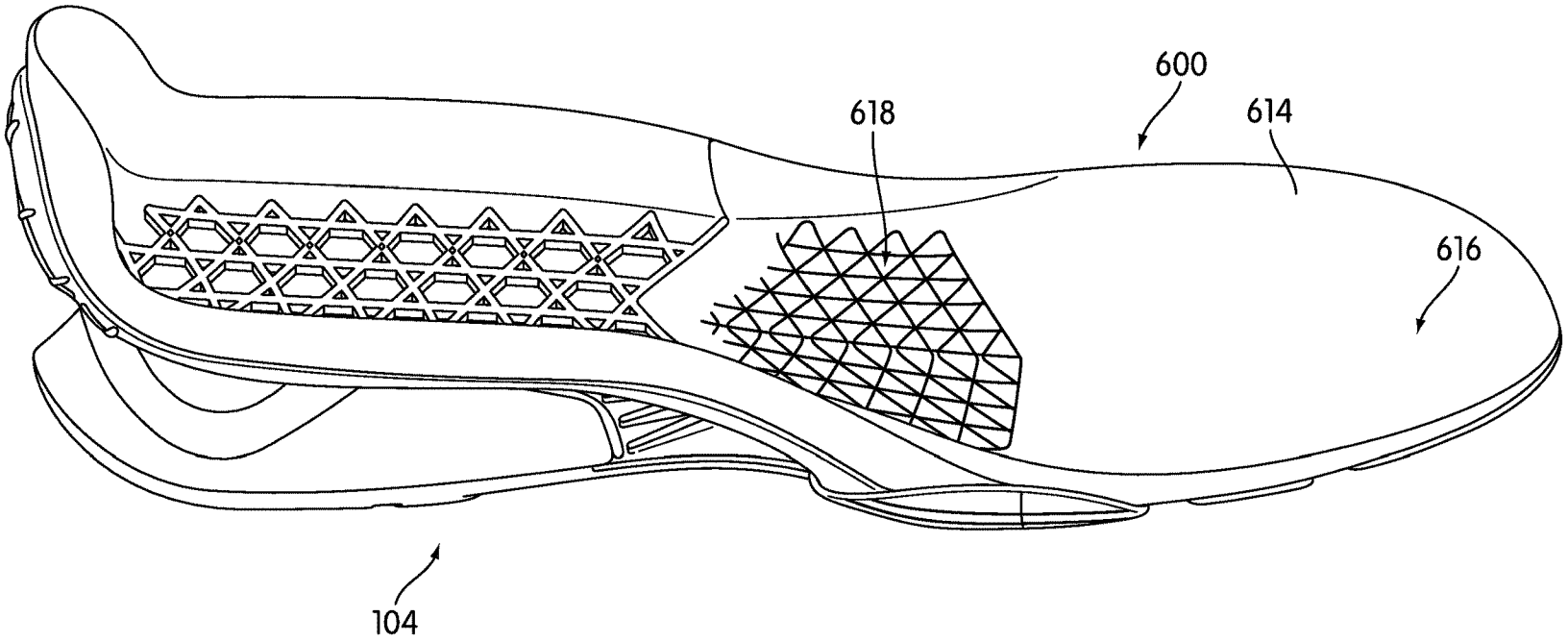
FIG. 19 is an isometric view of an embodiment of the forefoot plate, with the upper plate, heel system, lower plate and outsole.

FIG. 19 shows an isometric view of sole 104 including forefoot plate 600 with all of the other above discussed components. Forefoot plate 600 may include top surface 614, which may be divided into substantially flat region 616 and patterned region 618. Patterned region 618 may include a variety of etched ridges in order to provide increase flexibility and reduced weight.

Accordingly, any of the above discussed features may be used solely or in combination in order to provide an advantageous sole 104 for an article of footwear 100.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. An article of footwear comprising:

a sole, the sole including a heel system;

the heel system including a first elongated heel support member associated with a lateral side of the article of footwear, the heel system including a second elongated heel support member associated with a medial side of the article of footwear, the first elongated heel support member and the second elongated heel support member angled and extending from a heel region to a midfoot region in order to disperse forces applied by a wearer's heel during movement; and a plurality of ribs located in the midfoot region abutting a front edge of the first and second elongated heel support members; and the sole including a midsole and an upper plate, the upper plate including a lateral side flap and a medial side flap; and wherein the lateral side flap and the medial side flap are each located in the heel region of the article of footwear and extending downward from the upper plate so as to overlap the midsole.

2. The article of footwear of claim 1, wherein the first elongated heel support member and the second elongated heel support member have substantially similar shapes while being symmetric about a heel-toe center axis of the article of footwear.

3. The article of footwear of claim 1, the first elongated heel support member including a first top side and a first bottom side, the second elongated heel support member including a second top side and a second bottom side, wherein a length of the first elongated heel support member increases from the first top side to the first bottom side, and a length of the second elongated heel support member increases from the second top side to the second bottom side.

4. The article of footwear of claim 1, the first elongated heel support member including a first top side and a first bottom side, the second elongated heel support member including a second top side and a second bottom side, wherein a width of the first elongated heel support member increases from the first top side to the first bottom side, and a width of the second elongated heel support member increases from the second top side to the second bottom side.

5. The article of footwear of claim 1, wherein each of the first elongated heel support member and the second elongated heel support member compress vertically and deform horizontally in response to the forces applied by the wearer's heel during movement.

6. The article of footwear of claim 1, wherein the sole further includes a lower plate, the lower plate including a wall aligned transversely across the article of footwear, the wall being located in the midfoot region of the article of footwear, and the plurality of ribs extending from the wall towards the heel region of the article of footwear.

7. The article of footwear of claim 1, wherein the lateral side flap has a first horizontal stiffness, the medial side flap has a second horizontal stiffness, and the first horizontal stiffness is different from the second horizontal stiffness.

8. The article of footwear of claim 1, wherein the plurality of ribs include:

a first group of at least one rib, a center rib, and a second group of at least one rib; and the first group and the second group are symmetric in shape and location about the center rib.

9. An article of footwear comprising:

a sole, the sole including a heel system;

the heel system including a first heel support member associated with a lateral side of the article of footwear, the heel system including a second heel support member associated with a medial side of the article of footwear, the first heel support member and the second heel support member angled and extending from a heel region to a midfoot region, wherein each of the first heel support member and the second heel support member compress vertically and deform horizontally in response to forces applied by a wearer's heel during movement; and the sole further including a midsole, a lower plate, and an upper plate, with the heel system located between the lower plate and the upper plate, the lower plate including a one or more ribs and a wall extending upward from the lower plate and the one or more ribs extend from the wall towards the heel region of the article of footwear, the upper plate including a lateral side flap and a medial side flap; and wherein the lateral side flap and the medial side flap are each located in the heel region of the article of footwear and extending downward from the upper plate so as to overlap the midsole.

10. The article of footwear of claim 9, wherein the first heel support member and the second heel support member have substantially similar shapes while being symmetric about a heel-toe center axis of the article of footwear.

11. The article of footwear of claim 9, the first heel support member including a first top side and a first bottom side, the second heel support member including a second top side and a second bottom side, wherein a length of the first heel support member increases from the first top side to the first bottom side, and a length of the second heel support member increases from the second top side to the second bottom side.

12. The article of footwear of claim 9, the first heel support member including a first top side and a first bottom side, the second heel support member including a second top side and a second bottom side, wherein a width of the first heel support member increases from the first top side to the first bottom side, and a width of the second heel support member increases from the second top side to the second bottom side.

13. The article of footwear of claim 9, wherein the lateral side flap has a first horizontal stiffness, the medial side flap has a second horizontal stiffness, and the first horizontal stiffness is different from the second horizontal stiffness.

14. The article of footwear of claim 9, wherein the one or more ribs include multiple ribs and the multiple ribs include:

a first group of at least one rib, a center rib, and a second group of at least one rib; and the first group and the second group are symmetric in shape and location about the center rib.

15. An article of footwear comprising:

a sole, the sole including an outsole, a lower plate, a heel support system, and an upper plate, wherein the lower plate is adjacent to the outsole on a bottom side of the lower plate and adjacent to the heel support system on a top side of the lower plate, the heel support system is adjacent to the lower plate on a bottom side of the heel support system and adjacent to the upper plate on a top side of the heel support system, and the upper plate is adjacent to the heel support system on a bottom side of the upper plate in a rear portion and adjacent to a portion of the lower plate on a forward portion of the bottom side of the upper plate;

the heel support system including a first heel support member associated with a lateral side of the article of footwear, the heel support system including a second heel support member associated with a medial side of the article of footwear, the first heel support member and the second heel support member angled and extending from a heel region to a midfoot region; and the lower plate including a one or more ribs and a wall extending upward from the lower plate and the one or more ribs extend from the wall towards the heel region of the article of footwear, the upper plate including a lateral side flap and a medial side flap; and wherein the lateral side flap and the medial side flap are each located in the heel region of the article of footwear and extending downward from the upper plate.

16. The article of footwear of claim 15, wherein the first heel support member and the second heel support member have substantially similar shapes while being symmetric about a heel-toe center axis of the article of footwear.

17. The article of footwear of claim 15, the first heel support member including a first top side and a first bottom side, the second heel support member including a second top side and a second bottom side, wherein the first bottom side and the second bottom side are contiguous with the lower plate.

18. The article of footwear of claim 15, the first heel support member including a first top side and a first bottom side, the second heel support member including a second top side and a second bottom side, wherein a length and a width of the first heel support member increases from the first top side to the first bottom side, and a length and a width of the second heel support member increases from the second top side to the second bottom side.

19. The article of footwear of claim 15, wherein the lateral side flap has a first horizontal stiffness, the medial side flap has a second horizontal stiffness, and the first horizontal stiffness is different from the second horizontal stiffness.

20. The article of footwear of claim 15, wherein the one or more ribs include multiple ribs and the multiple ribs include:

a first group of at least one rib, a center rib, and a second group of at least one rib; and the first group and the second group are symmetric in shape and location about the center rib.

* * * * *